US005222838A

United States Patent [19]

Kennedy et al.

[11] Patent Number: 5,222,838

[45] Date of Patent: Jun. 29, 1993

[54] POWER MINE DOOR SYSTEM

[75] Inventors: William R. Kennedy; John M. Kennedy, both of Taylorville, Ill.

[73] Assignee: Jack Kennedy Metal Products and Buildings, Taylorville, Ill.

[21] Appl. No.: 917,863

[22] Filed: Jul. 21, 1992

Related U.S. Application Data

[62] Division of Ser. No. 733,213, Jul. 19, 1991.

[51] Int. Cl.[5] ..... E21D 9/00; E21F 1/00

[52] U.S. Cl. ..... 405/302; 49/123; 49/368; 52/217; 405/132; 405/150.1

[58] Field of Search ..... 405/132, 150.1, 303; 52/217, 126.4; 49/118, 123, 368, 367

[56] References Cited

U.S. PATENT DOCUMENTS

| | | | |
|---|---|---|---|
| 1,468,053 | 9/1923 | Townsend . | |
| 1,544,751 | 7/1925 | Haynes et al. . | |
| 1,798,392 | 3/1931 | Adams, Jr. et al. . | |
| 1,891,051 | 12/1932 | Neese . | |
| 3,438,147 | 4/1969 | Lander | 49/7 |
| 4,064,924 | 12/1977 | Catlett | 160/354 |
| 4,084,347 | 4/1978 | Brown | 49/397 |
| 4,543,746 | 10/1985 | Racca | 49/118 |
| 4,583,324 | 4/1986 | Storz et al. | 49/367 |
| 4,653,229 | 3/1987 | Feucht et al. | 49/367 |
| 4,911,577 | 3/1990 | Kennedy et al. | 405/132 |

FOREIGN PATENT DOCUMENTS

| | | |
|---|---|---|
| 722335 | 1/1955 | United Kingdom . |
| 2234010 | 1/1991 | United Kingdom . |

*Primary Examiner*—Dennis L. Taylor

*Attorney, Agent, or Firm*—Senniger, Powers, Leavitt & Roedel

[57] ABSTRACT

A mine door system including a door frame to be installed in a mine passageway to define a generally rectangular doorway. A mine door is defined by a pair of generally rectangular door leafs which are hinged on the door frame at opposite sides of the doorway for swinging between an open position to permit passage through the doorway and a closed position in which the door leafs are generally coplanar and close the doorway. The door leafs are so dimensioned that there is a substantial vertical gap between the door leafs when they are closed to accommodate convergence of side walls of the passageway. A relatively wide vertical sealing flap is secured to one of the door leafs for overlapping a face of the other door leaf when the door is closed for covering the gap between the door leafs. A power mechanism for opening and closing the door leafs is operable to control the sequence in which the door leafs close so that the door leaf carrying the sealing flap closes after the other door leaf for ensuring that the sealing flap closes against the face of the other door leaf.

20 Claims, 16 Drawing Sheets 28
200
201
202
204
206
208
210
212
214
216
218
220
221

POWER MINE DOOR SYSTEM

This is a division of application Ser. No. 07/733,213, filed Jul. 19, 1991.

BACKGROUND OF THE INVENTION

This invention relates generally to mine doors, and more particularly to a mine door system for installation in a passageway in a mine.

Mine doors are widely used to block air flow yet allow passage through passageways in mines, and to further act as fire barriers. Many such doors are difficult and time-consuming to install; and many cannot be readily adjusted to fit passageways of varying dimension. Moreover, existing mine doors often fail to provide a substantially air-tight seal to block the flow of air through a mine passageway, especially if the door is displaced due to convergence of the walls and/or ceiling of the passageway.

Existing mine doors, such as disclosed in co-assigned U.S. Pat. No. 4,911,577, are closed and opened manually. There is presently a need to provide a power operated mine door. For reasons of safety, such a power mine door should preferably be equipped so that it cannot apply undue opening or closing forces against an object (e.g., a person) in its path.

It is occasionally desirable to access a mine passage blocked-off by a mine door without opening the mine door. The provision of a smaller door, which is referred to as a man door, permits such access. However, such a door may be difficult to open when there is a substantial pressure difference on opposite sides of the door.

SUMMARY OF THE INVENTION

Among the several objects of this invention may be noted the provision of a mine door system which is preferably power operated; the provision of such a system which is readily adjustable to accommodate passageways of different heights, including passageways having low ceilings; the provision of such a system which has a fail-safe feature to shut off power to the door to avoid injury to a person in the path of travel of the door; the provision of such a system which allows passage through the mine door without opening the mine door and regardless of pressure differences across the mine door; the provision of such a system which is adapted to provide an essentially air-tight seal of the passageway when the door is closed; and the provision of such a system which remains air-tight even after a convergence of the passageway in which the door is installed.

In one aspect of this invention, a mine door system for installation in a passageway in a mine comprises a door frame adapted to be installed in the passageway to define a generally rectangular doorway, the door frame having a top and opposite sides. The mine door further comprises a pair of door leafs hinged on opposite sides of the door frame for swinging between an open position to permit passage through the doorway and a closed position in which the door leafs are generally coplanar and close the doorway. Each door leaf is generally rectangular in shape with a top horizontal edge, a bottom horizontal edge, a generally vertical hinged side edge adjacent a respective side of the door frame, a generally vertical free side edge opposite the hinged side edge, a first leaf face facing away from the top of the door frame when the door leaf is closed, and a second leaf face facing toward the top of the door frame when the door leaf is closed. The door leafs are so dimensioned that there is a substantial vertical gap between the door leafs when they are closed to accommodate convergence of side walls of the passageway. A relatively wide vertical sealing member is secured to the first face of one of the door leafs adjacent its free side edge and projects laterally therefrom for overlapping the first face of the other door leaf adjacent its free side edge thereby to cover the gap between the door leafs when the door leafs are closed. The door leafs have upper corner regions relieved to provide notch-like recesses adjacent the gap on opposite sides of the gap extending from the first leaf faces of the door leafs to the second leaf faces of the door leafs. The sealing member has an inclined upper end portion configured so that, when the door leafs are closed, it slopes upwardly through said recesses and said gap for substantially the full depth of the gap from the first face of each door leaf to the second face of each door leaf. The inclined upper end portion of the sealing member terminates in a tip engageable with the top of the door frame when the door leafs are closed thereby to inhibit the passage of air through the gap at a location adjacent the top of the door frame.

In another aspect of this invention, the mine door system comprises a door frame adapted to be installed in the passageway of a mine to define a doorway. The frame comprises a pair of vertical columns at opposite sides of the doorway and a generally horizontal lintel spanning the columns and extending across the top of the doorway. A mine door is mounted on the door frame for movement between open and closed positions. The lintel comprises a first horizontal hollow box beam lying generally in the plane of the vertical columns and a second horizontal box beam attached to the first beam at one side of the first beam and generally in the same horizontal plane as the beam so that the second beam does not project substantially above the first beam, thereby minimizing the overall depth of the lintel.

In another aspect of this invention, the mine door system comprises a door frame adapted to be installed in the passageway of a mine to define a doorway. The mine door system comprises a mine door having a relatively large surface area exposed to the flow of air through the passageway. The door has air seals at its perimeter to inhibit the flow of air therepast. A man opening is provided in the mine door sufficiently large to permit passage of a person therethrough so that a person may pass through the mine door when it is closed. A man door is hinged on the mine door for swinging between a closed position for closing the man opening and an open position. The system also includes a pressure relief opening in the man door, and a pressure relief door mounted on the man door movable between a closed position for closing the pressure relief opening and an open position for relieving pressure against the man door to permit the man door more readily to be swung open to permit passage of a person therethrough.

In another aspect of this invention, the mine door system comprises a door frame adapted to be installed in the passageway of a mine to define a generally rectangular doorway, and a mine door comprising at least one door leaf hinged on the door frame for swinging between an open position to permit passage through the doorway and a closed position for closing the doorway. The door leaf is generally rectangular in shape with a top horizontal edge, a bottom horizontal edge, a generally vertical side edge hinged to the door frame, a generally vertical free side edge opposite the hinged side edge, and opposite leaf faces, and electric power means for opening and closing the door leaf. The improvement comprises switch means for controlling the operation of the electric power means, and pressure-sensitive actuator means mounted on at least one face of door leaf. The actuator means is responsive to pressure due, for example, to contact with a person as the door opens or closes, to actuate the switch means to de-energize the electric power means.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF PREFERRED EMBODIMENTS

Figure 1:
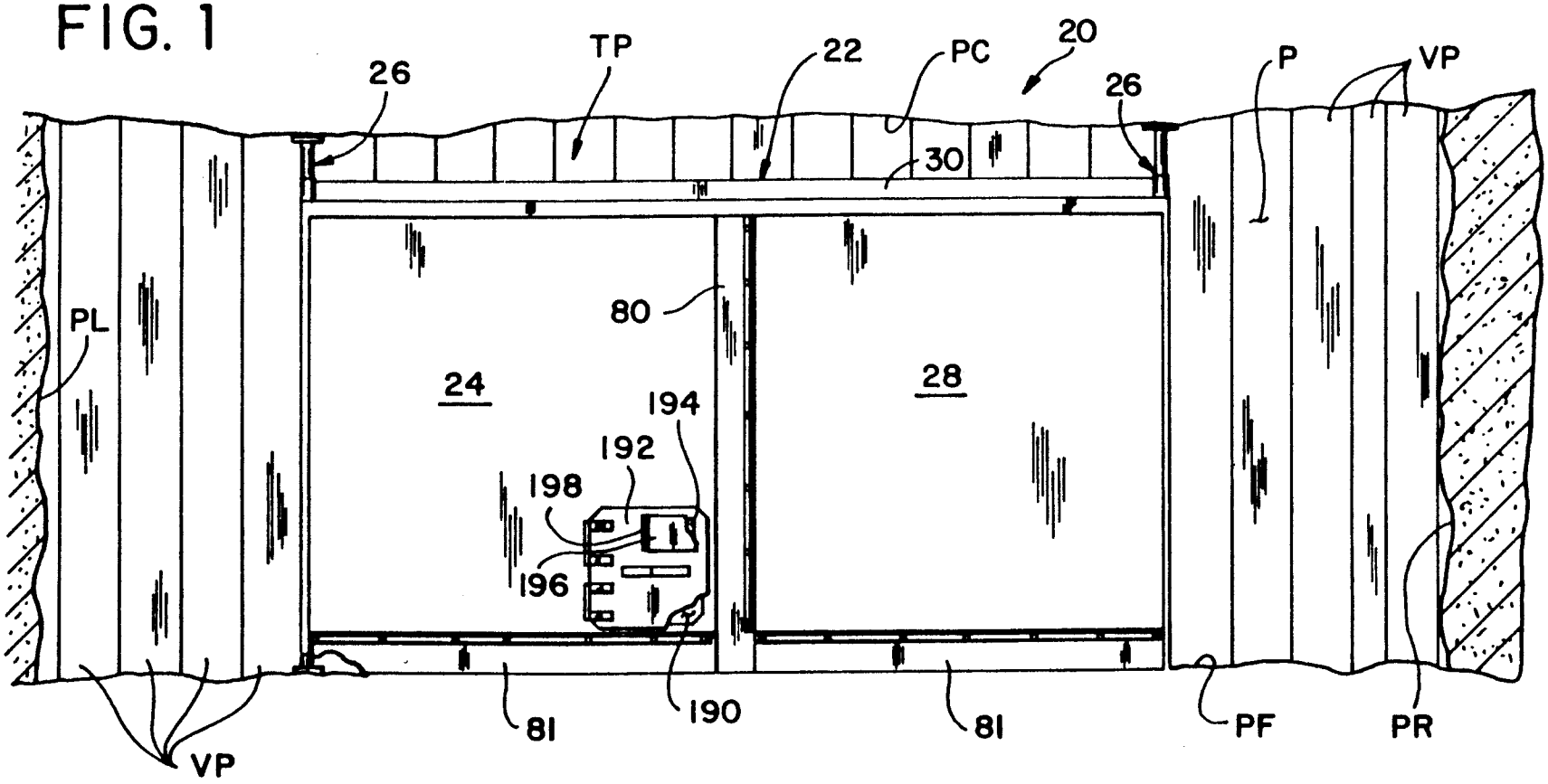
FIG. 1 is a front elevation of a power mine door system of the present invention as installed in a mine passageway.

Referring now to the drawings, and first to FIG. 1, there is generally indicated at 20 a power mine door system of this invention installed in a mine passageway P having a floor PF, ceiling PC and left and right ribs indicated at PL, PR, respectively. The door system 20 comprises a door frame, generally designated 22, which defines a doorway, and a pair of generally rectangular door leafs 24 and 28 hinged on the door frame at opposite sides of the doorway for swinging between a open position to permit passage through the doorway and a closed position in which the door leafs are generally coplanar and close the doorway. As illustrated in FIG. 1, a top panel structure TP of the type described in co-assigned U.S. Pat. No. 4,911,577 may be provided to close the space between the top of the frame 22 and the ceiling PC of the mine passageway. The gaps between the door frame 22 and the ribs PL, PR of the passageway may be closed by vertical panels VP, also described in the aforementioned patent.

Figure 2:
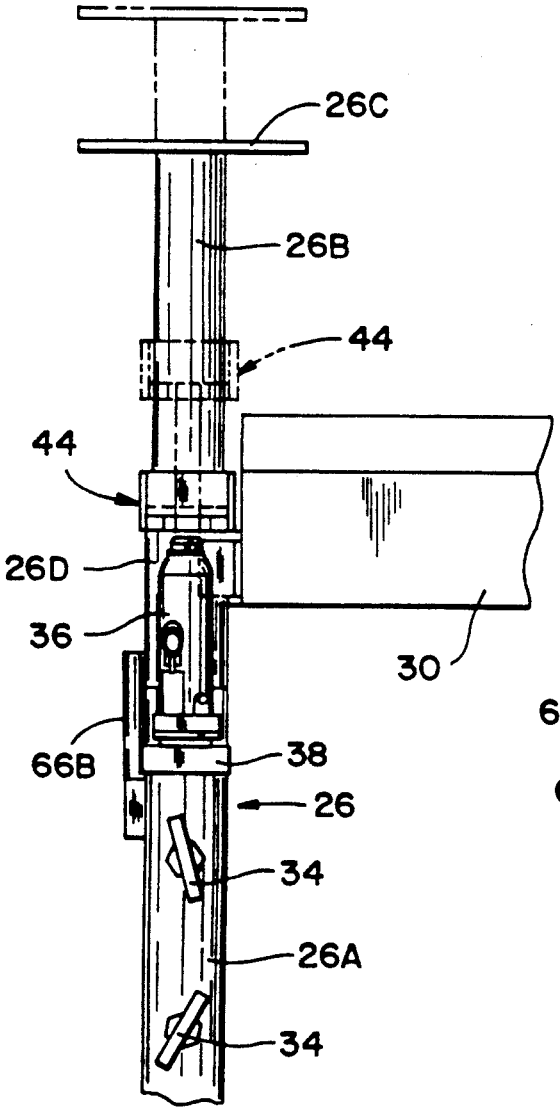
FIG. 2 is a rear elevation of a column of the power mine door system showing in phantom an upper section of the column in a raised position.
Figure 3:
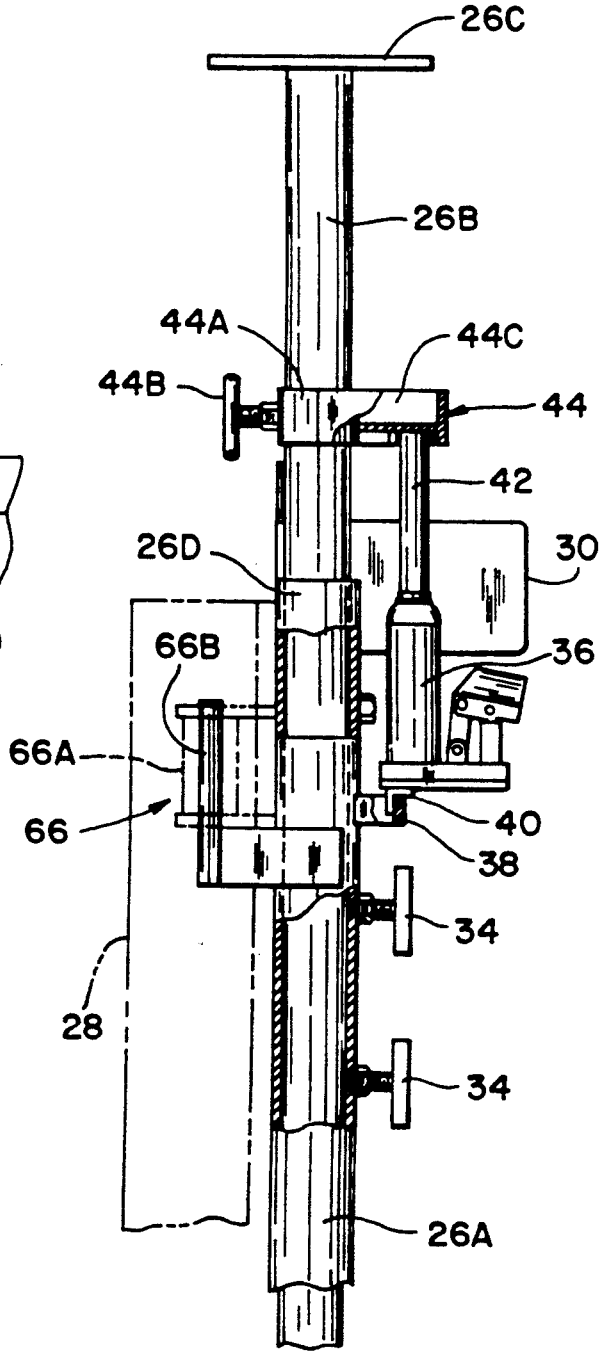
FIG. 3 is a side elevation of the column.

The door frame 22 comprises a pair of vertical metal columns generally designated 26 at opposite sides of the doorway and a lintel 30 supported by the columns and extending across the top of the doorway. Each column 26 has a foot (lower) end engageable with the floor PF of the passageway and a head (upper) end engageable with the ceiling PC. As shown in FIGS. 2 and 3, each column 26 includes a first or lower tubular column section 26A, a second or upper tubular column section 26B telescopically slidable in the lower column section and having a support plate 26C at its upper end for engagement with the ceiling PC of the passageway, and a third or middle tubular section 26D abutting the upper end of the lower section 26A co-axial with the upper and lower column sections. The lintel 30 is affixed (e.g., welded) at one of its ends to this middle column section 26D and at its other end to the middle section 26D of the column at the opposite side of the doorway. The upper section 26B of each column telescopes with respect to both the middle and lower column sections 26D, 26A and is yieldably locked in adjusted position relative to these sections by locking means comprising a pair of locking bolts 34 threaded through the lower column section 26A into frictional engagement with the upper column section 26B, as described in detail in U.S. Pat. No. 4,911,577.

In accordance with this invention, portable jack means in the form of a relatively small hydraulic bottle jack 36 is adapted to be removably mounted on each column 26 by means of a bracket 38 (support means) rigidly attached to the lower column 26A. As best illustrated in FIG. 3, the bracket 38 projects from the lower column section 26A and is engageable by an angle 40 secured to the base of the jack 36 to support the jack in a position where its vertically extensible cylinder rod 42 (which may be generally referred to as a lifting member) is positioned directly below a lifting assembly generally designated 44 on the upper column section 26B. The lifting assembly 44 comprises a collar 44A slidable vertically on the upper column section 26B, means in the form of a T-bolt 44B threaded through a nut on the collar into frictional engagement with the upper column section for yieldably locking the collar in the desired vertical position relative to the upper section, and a lift member 44C on the collar engageable by the upper end of the cylinder rod 42 of the jack. The arrangement is such that operation of the jack 36 to vertically extend the cylinder rod 42 telescopically raises the upper column section 26B relative to the lower section thereby to adjust the height of the column 26 according to the height of the passageway. After the upper column section 26B has been raised to bring the support plate 26C at its upper end into pressure engagement with the mine ceiling PC, the locking bolts 34 are tightened to yieldably lock the upper section in fixed position relative to the lower section 26A, at which time the cylinder rod 42 of the jack may be retracted so that the jack 36 may then be removed from the bracket 38. Alternatively, the jack may be mounted on the lintel 30 for engagement of its cylinder rod 42 with the lift member 44C. It will be noted that once the cylinder rod 42 is retracted, the upper column section 26B will yield relative to the lower section 26A in the event of a floor-to-ceiling convergence (such yielding resulting from slippage of the upper column section 26B relative to the locking bolts 34).

The bottle jack arrangement as described above has several advantages, including providing for precise vertical adjustment of the height of the column 26 without the use of threads, thereby making such adjustment faster and easier and less expensive while permitting the column to yield in the event of a vertical convergence of the mine passageway; providing for a greater range of vertical adjustment at less cost; permitting the use of one jack for many installations; and providing for greater roof-to-floor pressure capability.

Figure 4:
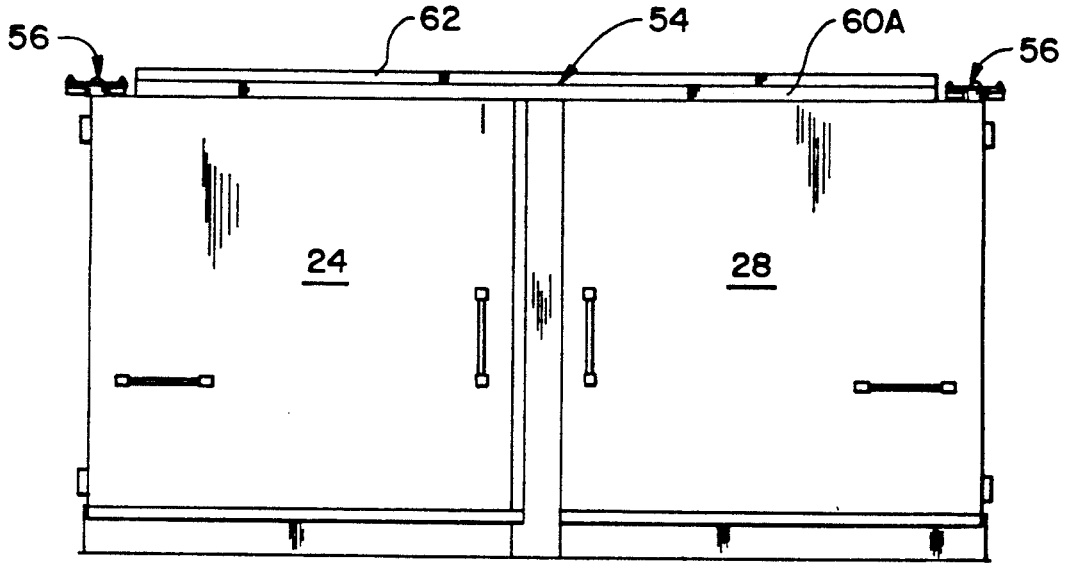
FIG. 4 is a front elevation of a power mine door system incorporating a different column design for reducing the overall height of the system.
Figure 5:
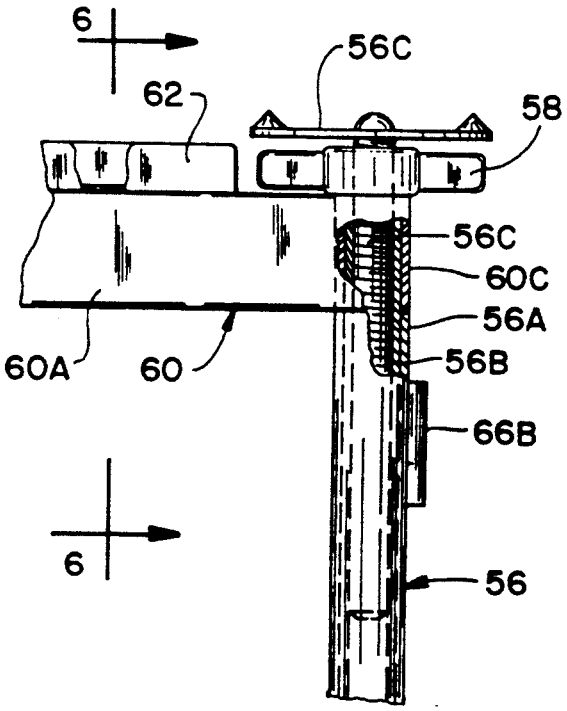
FIG. 5 is an enlarged portion of FIG. 4 showing the construction of a column.
Figure 6:
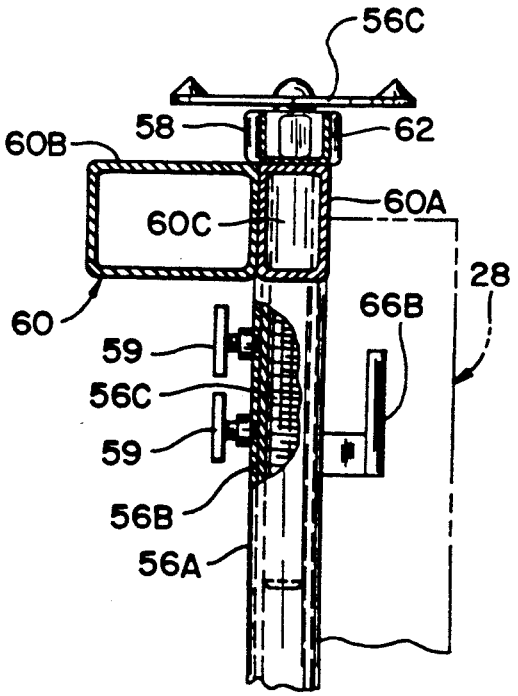
FIG. 6 is a section taken in the plane including line 6—6 of FIG. 5.

In instances where the floor to ceiling dimension of the passageway P is small, and maximum doorway height is needed, it is important to minimize the overall height of the door frame 22. In this event, a door frame 54 construction as illustrated in FIGS. 4–6 may be used (the door leaf 28 has been removed in FIGS. 5 and 6 for clarity). The door frame 54 comprises two columns 56 and a lintel 60 spanning the two columns 56 at the top of the doorway. Each column comprises a lower tubular column section 56A, an intermediate tubular column section 56B coaxially disposed in the lower section and telescopically adjustable relative thereto, an upper column section in the form of a threaded rod 56C coaxial with the intermediate section 56B and extending up above the intermediate section, a nut 58 rotatable on the rod for adjusting the vertical extension of the rod relative to the lower and intermediate column sections, and a support plate 56D mounted on the upper end of the threaded rod for pressure engagement with the ceiling PC of the passageway. A pair of T-fasteners 59 threaded through the lower column section 56A into frictional engagement with the intermediate section 56B constitute means for locking the intermediate section in adjusted vertical position relative to the lower section.

The lintel 60 illustrated in FIGS. 4–6 has a vertical sleeve 60C affixed (as by welding) to each of its ends, the diameter of each sleeve being the same as the diameter of the lower section 56A of a respective column 56. The upper end of the lower section 56A of each column is coaxially engageable with the lower end of the sleeve 60C, and the intermediate section 56B of the column extends up into the sleeve (and possibly beyond it, depending on the height of the mine passage). The threaded rod 56C extends up above the top of the intermediate column section 60B and sleeve 60C, and the nut 58 is disposed on the rod immediately above the intermediate section of the column, as shown.

To install the door frame in a mine passageway, the intermediate section 60B of each column 60 is extended relative to the lower section 60A to a point where the combined lengths of these two sections 60A, 60B is somewhat less that the overall height of the passageway. The two T-fasteners 59 are then tightened to yieldably lock the two sections in adjusted position. After both columns have been so adjusted, the lintel 60 is mounted on the columns so that the sleeves 60C at opposite ends of the lintel bear on the lower column sections 56A and the intermediate sections 56B of the columns extend up into the sleeves 60C. The two nuts 58 are then rotated to extend the rods 56C to bring the support plates 56D into pressure engagement with the mine roof.

The lintel 60 preferably comprises a first horizontal hollow box beam 60A of generally rectangular cross section lying generally in the plane of the vertical columns 56 and a second horizontal box beam 60B of generally rectangular section affixed (e.g., welded) to the first beam at the rear side of the first beam and generally at the same level as the first beam so that the second beam does not project substantially above the first beam, thereby minimizing the overall depth (vertical dimension) of the lintel 60. This side-by-side arrangement of the beams 60A, 60B has the additional advantages of strengthening the door frame 54 against impact of the door leafs 24, 28 against the frame, and reducing overall manufacturing costs due to simpler design and less material compared to the design shown in U.S. Pat. No. 4,911,577. In the event there is a gap between the lintel 60 and the ceiling, a horizontal channel member 62 may be secured along the upper surface of the first beam 60A. The channel 62 opens upwardly for receiving the lower ends of a plurality of side-by-side vertical panels (e.g., top panels TP) therein. Alternatively, the gap may be closed by blocks, mortar and/or other conventional building material.

Figure 7:
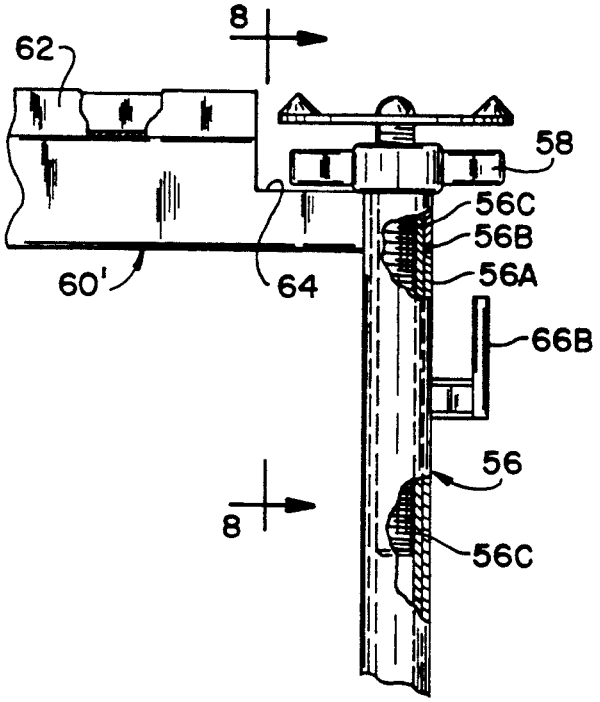
FIG. 7 is view similar to FIG. 5 showing a different construction for further reducing the overall height of the door system.
Figure 8:
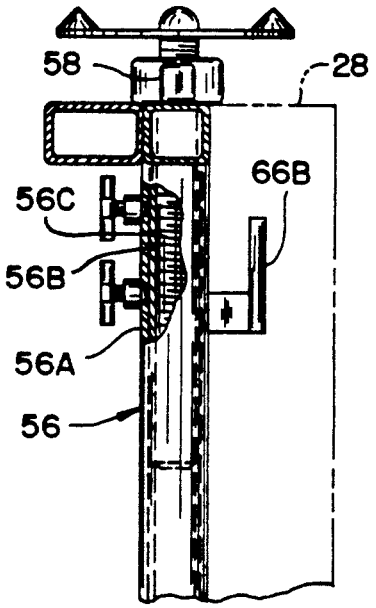
FIG. 8 is a section taken on line 8—8 of FIG. 7.

To reduce the height of the door frame 54 even more, a cutout or notch 64 may be provided in each end of the lintel 60' extending down from the upper surfaces of the hollow box beams 60A' and 60B', as shown in FIGS. 7 and 8 (for purposes of illustration door leaf 28 has been removed in FIG. 7). The nuts 58 engageable with the threaded rods 56B of the columns 56 are disposed in these notches 64 and are rotatable relative to the lintel 60' and to the threaded rods to adjust the vertical extension of the threaded rods.

Figure 9:
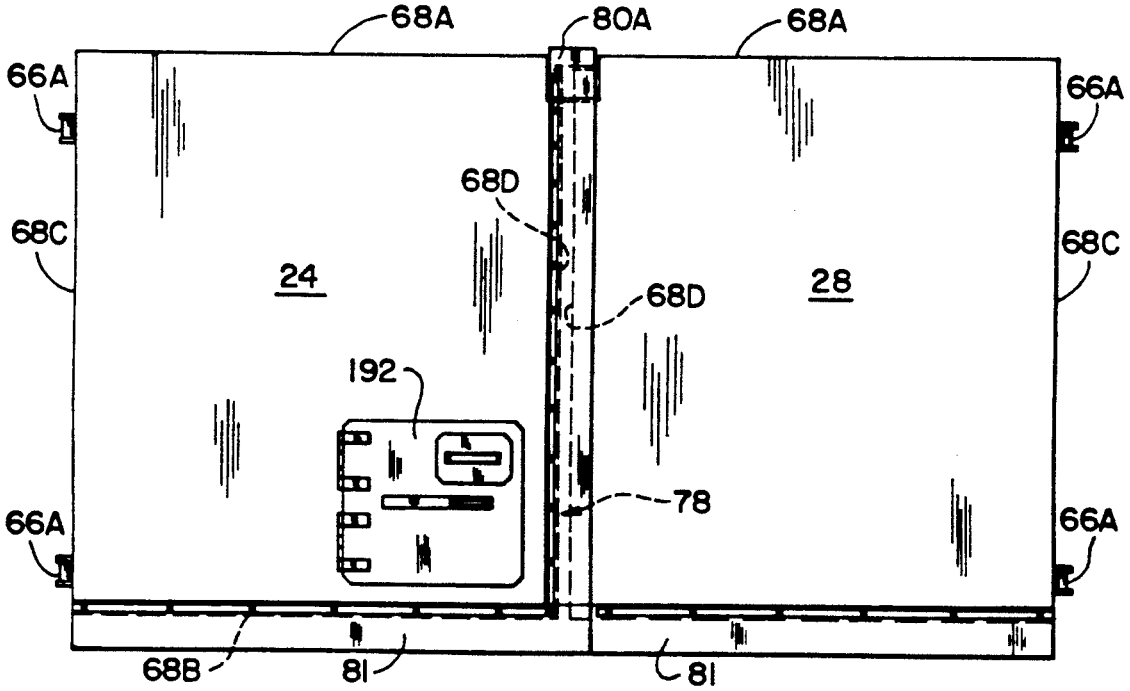
FIG. 9 is a front elevation of two door leafs of this invention, and a sealing flap covering the vertical gap between the door leafs.
Figure 10:
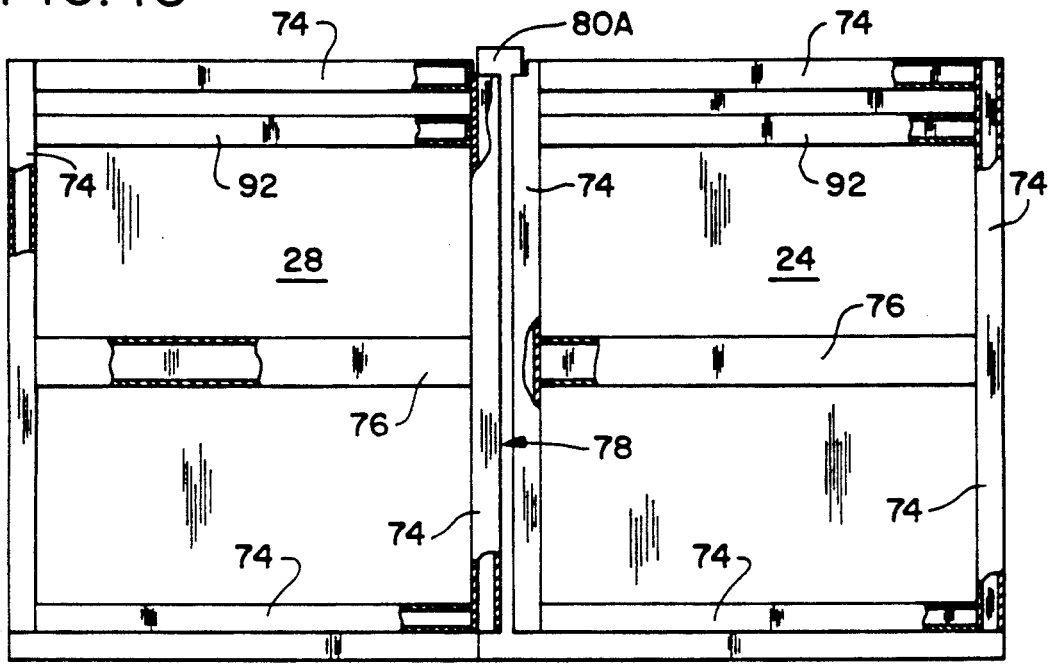
FIG. 10 is a rear elevation of the door leafs with parts broken away to show the construction of the door.

The door leafs 24, 28 are mounted on the columns (26 or 56) at opposite sides of the doorway by means of hinges generally indicated at 66 in FIG. 3. Each hinge 66 includes a sleeve element 66A attached to a respective door leaf and a pin element 66B mounted on the lower section of a respective column (26A or 56A). As illustrated in FIGS. 9 and 10, each door leaf is generally rectangular in shape with a top horizontal edge 68A, a bottom horizontal edge 68B, a generally vertical hinged side edge 68C adjacent a respective side of the door frame 22, and a generally vertical free side edge 68D opposite the hinged side edge. The leaf (24 or 28) has a first front face (visible in FIG. 9) which faces away from the door frame when the leaf is closed, and a second rear face (visible in FIG. 10) which faces toward the door frame when the door is closed. The leaf may have a construction similar to that described in U.S. Pat. No. 4,911,577, where a substantially continuous reinforcing structure of hollow box-beams 74 having generally rectangular sections extend around the perimeter of the door on the rear face of the leaf (the face toward the door frame), and one box-beam 76 extends horizontally across the leaf generally at its center on the rear face of the door leaf. Parts of the reinforcing structure have been broken away in FIG. 10 to show the box-beam construction. When the door leafs 24, 28 are closed, the top horizontal segment of the reinforcing structure on each door is positioned in close face-to-face relation with the lintel (30 or 60).

Figure 11:
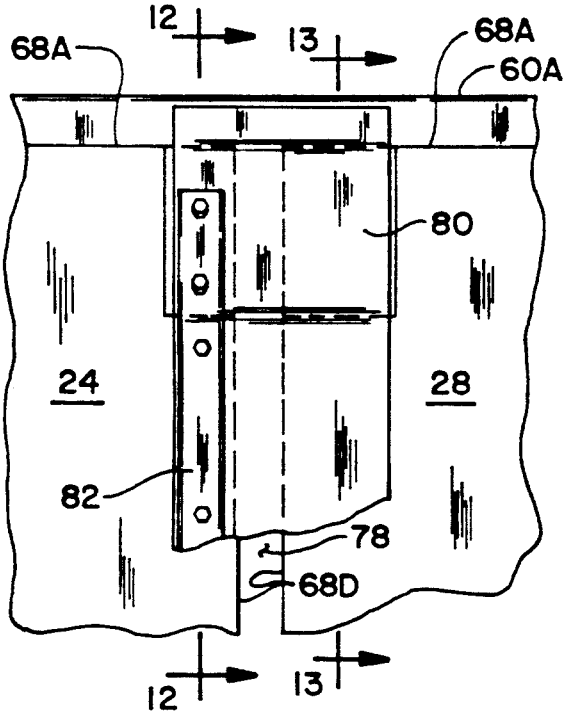
FIG. 11 is an enlarged portion of FIG. 9 showing the upper end of the sealing flap and associated door construction.
Figure 12:
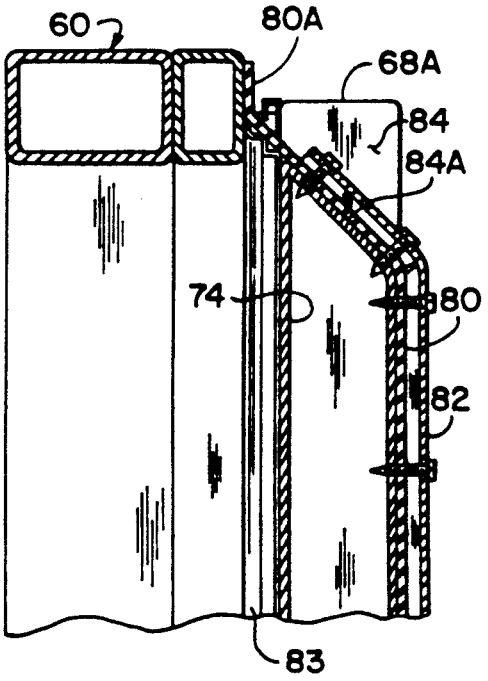
FIG. 12 is a vertical section taken on line 12—12 of FIG. 11.
Figure 13:
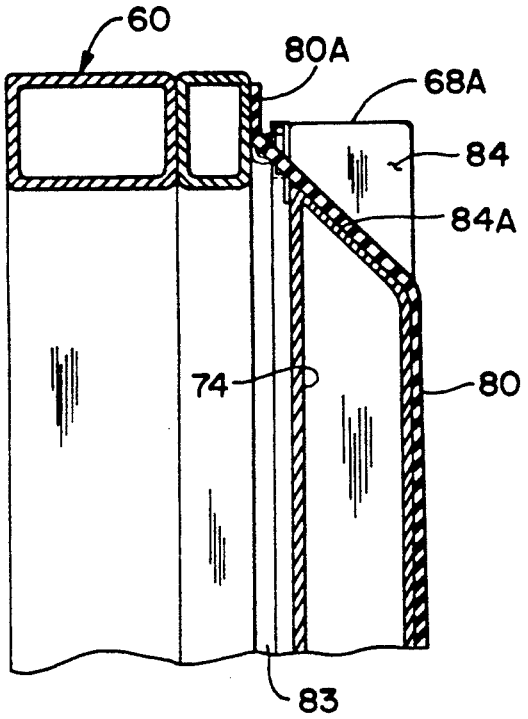
FIG. 13 is a vertical section taken on line 13—13 of FIG. 11.

As best shown in FIG. 11, each door leaf 24, 28 is so dimensioned that there is a substantial vertically extending gap 78 between the door leafs when they are closed to accommodate convergence of side walls of the passageway. A relatively wide vertical sealing member or flap 80 is secured by means of a vertical metal strip 82 fastened to the front face of one of the door leafs (the left leaf 24 as viewed in FIG. 11) adjacent its free side edge 68D. The flap 80 projects laterally from the leaf 24 for overlapping the front face of the other door leaf 28 adjacent its free side edge 68D thereby to cover the gap 78 between the door leafs when the door leafs are closed. A strip of elastomeric material 83 is attached to the rear face of each door leaf 24, 28 adjacent its upper edge 68A and outer edge 68C. This strip engages a respective column 26 and lintel 60. This seal is intended to provide an essentially airtight seal when the door leafs 24, 28 are closed. Sealing flaps 81 are secured along the bottom edges 68B of the door leafs to enhance this airtight seal.

To seal against the escape of air at the top of gap 78 between the door leafs 24, 28 through the space between the lintel 60 and the rear face of the door, the door leafs have upper corner regions relieved to provide notch-like recesses 84 on opposite sides of the gap 78 extending the full thickness of each leaf from its front face to its rear face (FIGS. 11–14). These recesses 84 involve removal of upper corner portions of the aforementioned reinforcing structure (box-beams 74) on the rear face of the door. The bottom of each recess 84 is defined in part by a shoulder 84A spaced below the top edge 68A of the door leaf formed by an extension of the front face of the door leaf extending inwardly from the free outer edge 68D of the door leaf. As viewed in FIGS. 12 and 13, the shoulder is inclined upwardly from the front leaf face to the rear leaf face (corresponding generally to the plane of the leftmost face of the reinforcing structure) for supporting the upper end portion of the sealing flap 80. The configuration of the flap 80 is such that, when the door leafs 24, 28 are closed, it slopes upwardly through the recesses 84 in the door leafs and through the gap 78 between the door leafs for substantially the full depth of the gap from the front face of each door leaf to the rear face of each door. The inclined upper end portion of the flap 80 terminates in a vertical tip 80A engageable with the lintel member 60 at the top of the door frame 22 when the door leafs 24, 28 are closed thereby to inhibit the passage of air through the gap 78 at a location adjacent the top of the door frame. The inclined upper end portion of the flap 80 preferably extends at about a 45° angle relative to the horizontal, although this angle may vary without departing from the scope of this invention.

Figure 14:
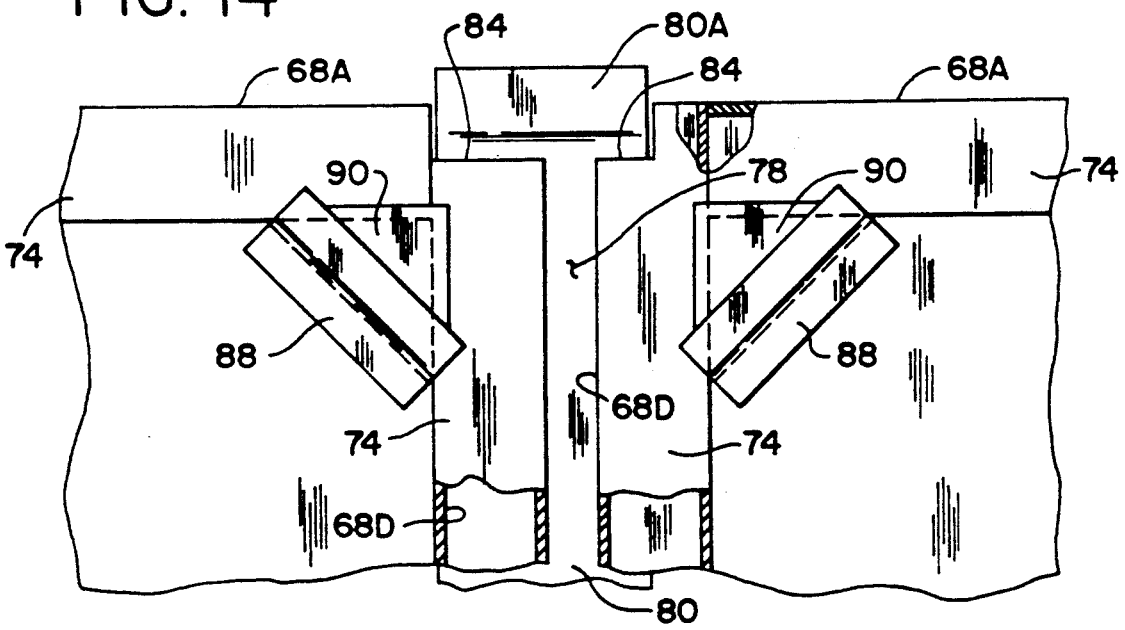
FIG. 14 is a rear elevation of a portion of the door showing details associated with the sealing flap.
Figure 15:
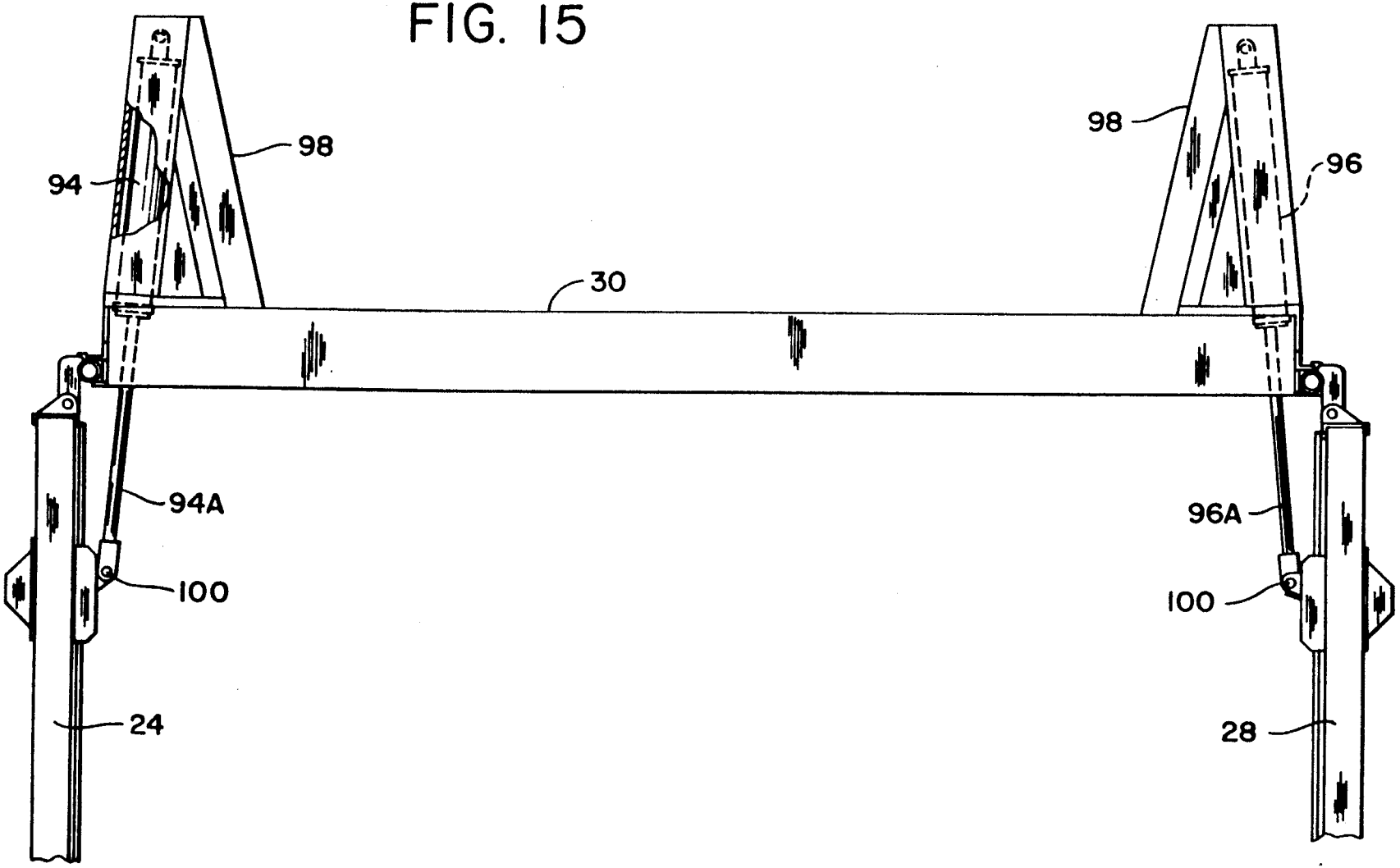
FIG. 15 is a top plan view of the power mine door system with door leafs of the mine door in an open position.
Figure 16:
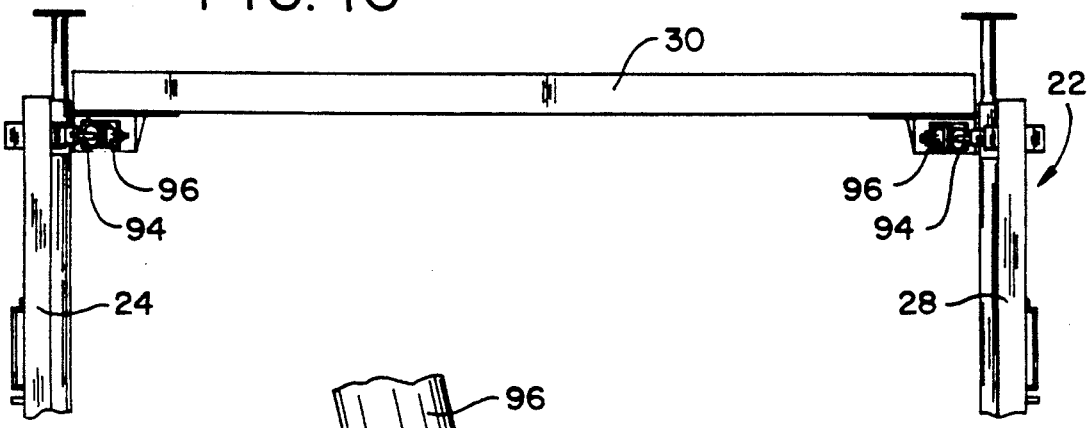
FIG. 16 is a fragmentary front elevation of the door system with the door leafs in an open position.

Because the provision of the notch-like recesses 84 in the door leafs may involve removal of corner portions of the reinforcing structure, steps should be taken to restore the strength of the reinforcement. As illustrated in FIG. 14, this may be accomplished by securing a corner brace 88 (e.g., a Z-brace) and cover plate 90 to the reinforcing structure adjacent the discontinuity formed by the recess 84. Alternatively, a separate horizontal segment of reinforcing structure, indicated at 92 in FIG. 10, may be provided at a location spaced below the top edge 68A of each door leaf at a level below the recess 84 in the door leaf. As shown in FIG. 10, this segment is connected to the reinforcing structure 74 along the sides of the door leaf to provide a substantially continuous loop of reinforcing structure around the door leaf.

Figure 17:
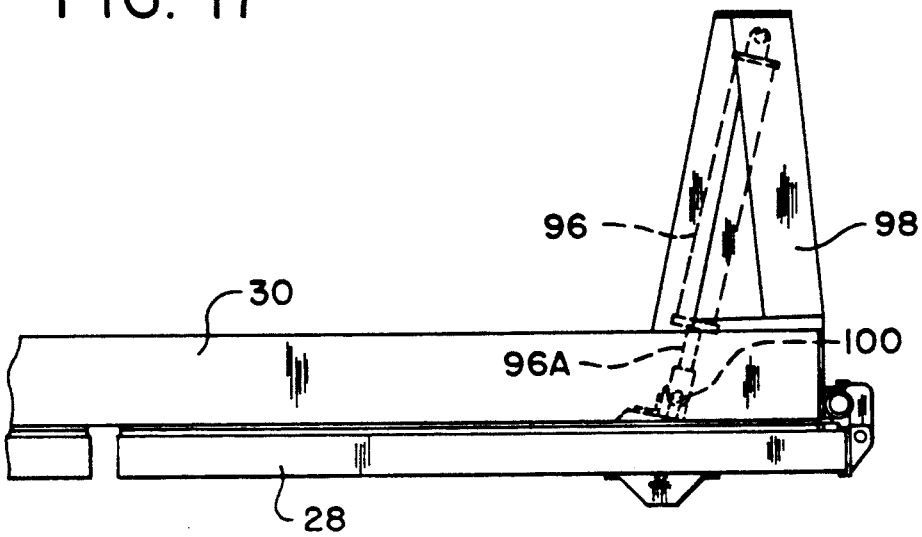
FIG. 17 is a fragmentary plan view of a door leaf showing the door leaf in a closed position.
Figure 18:
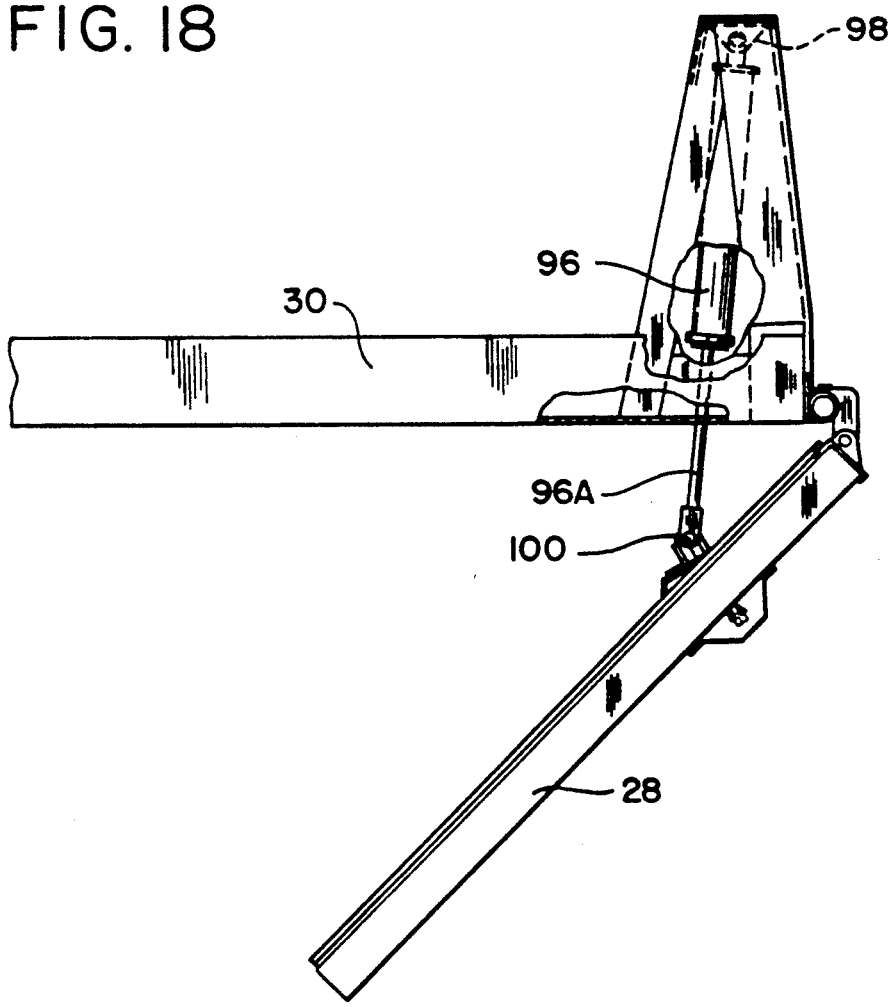
FIG. 18 is the fragmentary plan view similar to FIG. 17 showing the door leaf partially open.

The door leafs 24, 28 are opened by power means which, in the embodiment shown in FIGS. 15–22, comprises a pair of hydraulic cylinders, indicated by 94 and 96, respectively, pivoted on supports 98 affixed to the lintel 30 of the door frame adjacent opposite sides of the doorway. Each cylinder 94, 96 has an extensible and retractable cylinder rod 94A, 96A attached to a respective door leaf 24, 28 adjacent the top of the leaf and generally adjacent a respective side of the door frame 22. The cylinder rod 94A, 96A is extensible for opening the door leaf (FIGS. 15 and 16) and retractable for closing the door leaf (FIG. 17). As shown in FIG. 18, each hydraulic cylinder 94, 96 is adapted to pivot on its support 98 on a generally vertical axis in such a manner that the cylinder and its cylinder rod 94A, 96A are generally perpendicular to the plane of the doorway when the cylinder rod is extended. This ensures that the cylinders 94, 96 occupy only a relatively small space in the open doorway at opposite upper corners of the doorway to minimize obstruction of the open doorway (see FIGS. 15 and 16).

Figure 19:
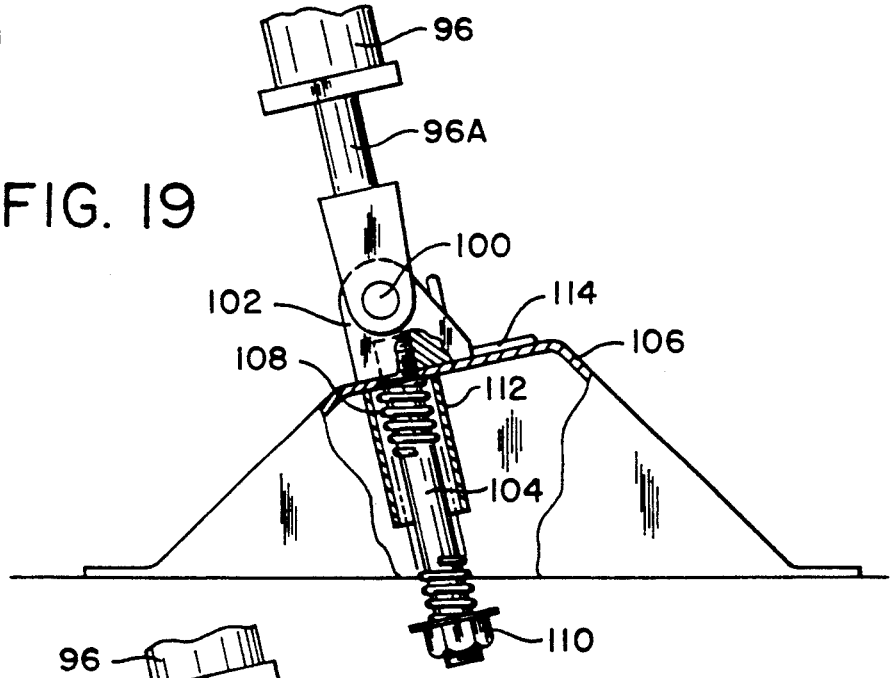
FIG. 19 is an enlarged plan showing how a cylinder rod is connected to a respective door leaf.
Figure 20:
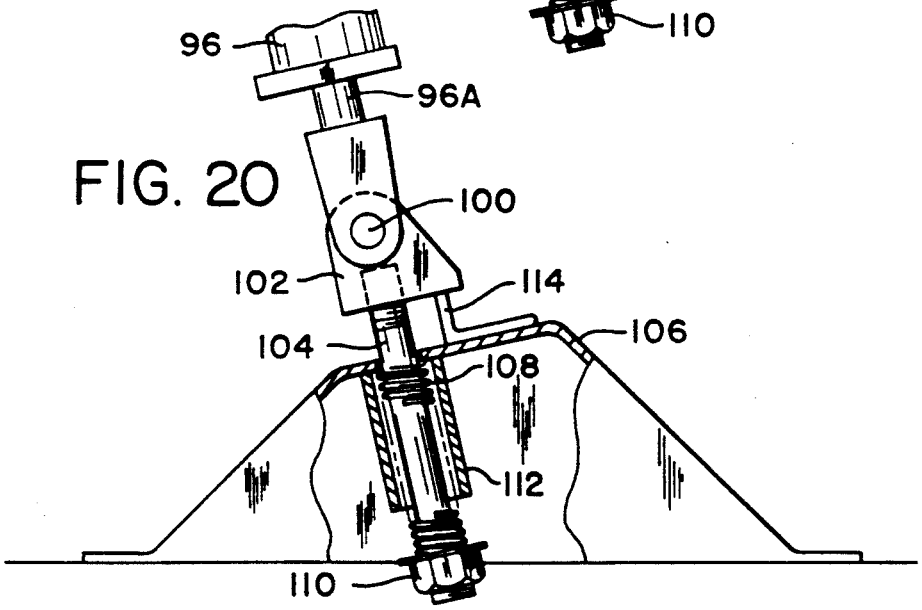
FIG. 20 is a view similar to FIG. 19 showing how the connection of the cylinder rod to the door permits some relative movement between the door and the rod.

The cylinder rod 94A, 96A of each cylinder 94, 96 is pivotally attached to a respective door leaf 24, 28 in the manner illustrated in FIGS. 19 and 20. The cylinder rod 94A, 96A has a clevis pivot connection 100 with a coupler 102 mounted on a threaded rod 104 secured to a bracket 106 affixed to the door leaf. A spring 108 reacting at one end against a nut 110 on the threaded rod 104 and at its other end against the bracket 106 permits limited retraction of the cylinder rod 94A, 96A relative to the door leaf when the door closes against the lintel 30 of the door frame to avoid excessive closing pressures, to provide some "give" in the case an obstruction is encountered as the door closes, and to compensate for door tolerances, wear, and movements of the mine passageway after installation (as during a mine convergence, for example). The travel of the cylinder rod 96A relative to the bracket 106 on the door is limited by the engagement of the nut 110 on the threaded rod 104 with a guide sleeve 112 surrounding the rod and affixed to the bracket 106. Movement of the coupler 102 is controlled by guides 114 on the bracket 106, one of which is illustrated in FIG. 20.

It will be noted that the pivotal mounting of the cylinders is such that the cylinders have their greatest leverage (i.e., exert the greatest door-opening force) when the door leafs 24, 28 are closed because the cylinders are generally perpendicular to the closed leafs. This is desirable because the load on the leafs is the greatest when they are closed due to air pressure. As the leafs begin to open and this air pressure decreases, the opening force exerted by the cylinders on the door leafs decreases and the opening speed of the leafs increases.

Figure 21:
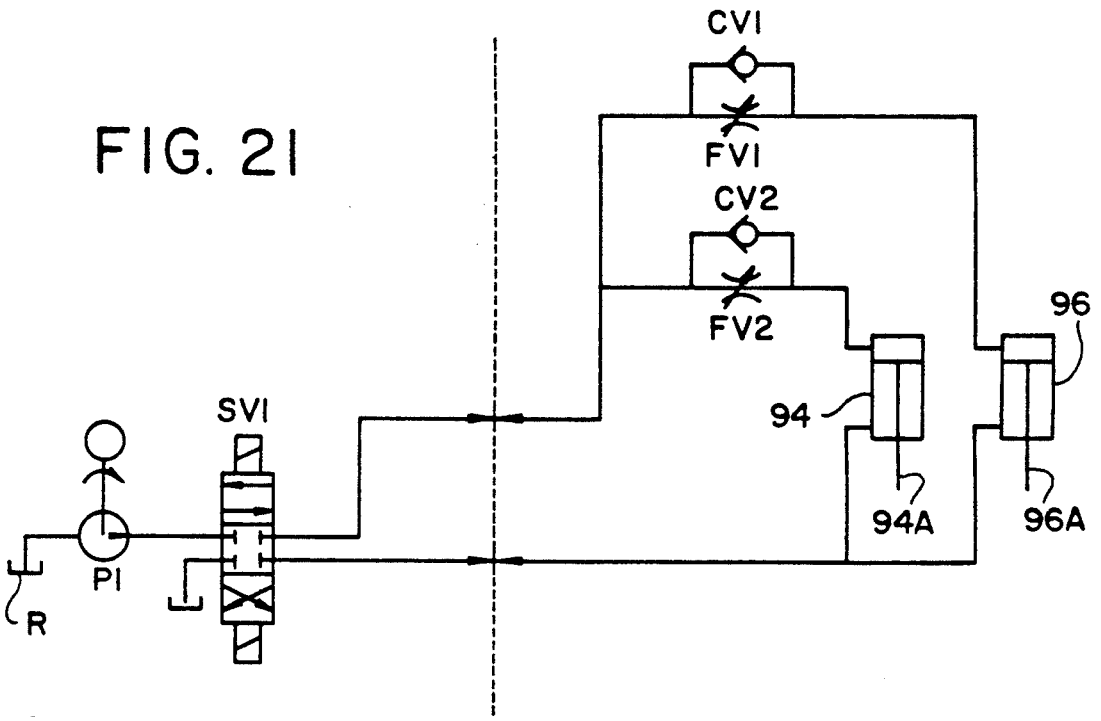
FIG. 21 is a schematic of a hydraulic circuit for the cylinders.

FIG. 21 shows an hydraulic circuit for the door opening cylinders 94, 96 described above. The circuit includes a pump P1 driven by an electric motor to pump hydraulic fluid from a reservoir R to a four-way solenoid valve SV1 movable from a first ("center") position in which flow through the circuit is blocked, to either a first ("straight") position in which fluid is pumped to the cylinders 94, 96 for extending the cylinder rods 94A, 96A to open the door leafs, or a second ("crossed") position in which fluid is pumped in reverse direction for retracting the cylinder rods to close the door leafs 24, 28. Flow to and from the cylinder 96 controlling door leaf 28 is regulated by a flow control valve FV1 and a check valve CV1 in a line bypassing the flow control valve, and flow to and from the cylinder 94 controlling the other door leaf 24 is regulated by a flow control valve FV2 and a check valve CV2 in a line bypassing the flow control valve FV2. The flow control valve FV1 is set for a flow rate less than the rate at which FV2 is set. As explained below, this controls the sequence in which the door leafs close so that the door leaf 24 carrying the sealing flap 80 closes after the other door leaf 28 for ensuring that the sealing member closes against the stated first face of the other door leaf to provide a proper seal.

In operation, when the solenoid valve SV1 is moved to its stated first (door opening) position, flow of hydraulic fluid to the cylinders 94, 96 is at rate substantially the same for both cylinders so that the door leafs 24, 28 will open substantially simultaneously. This is because the check valves CV1 and CV2 permit unrestricted flow through bypass lines to the cylinders. However, when the solenoid valve SV1 is moved to its stated second (door closing) position, FV1 restricts the flow of fluid from cylinder 96 to a greater extent than FV2 restricts the flow of fluid from cylinder 94, thus retarding the retraction of cylinder 96 relative to cylinder 94 so that door leaf 28 (the one without the sealing flap 80) closes first. Appropriate relief valves (not shown) may be provided in the circuit in the event hydraulic pressures exceed a predetermined maximum, as in the case of an obstruction to the door.

Figure 22:
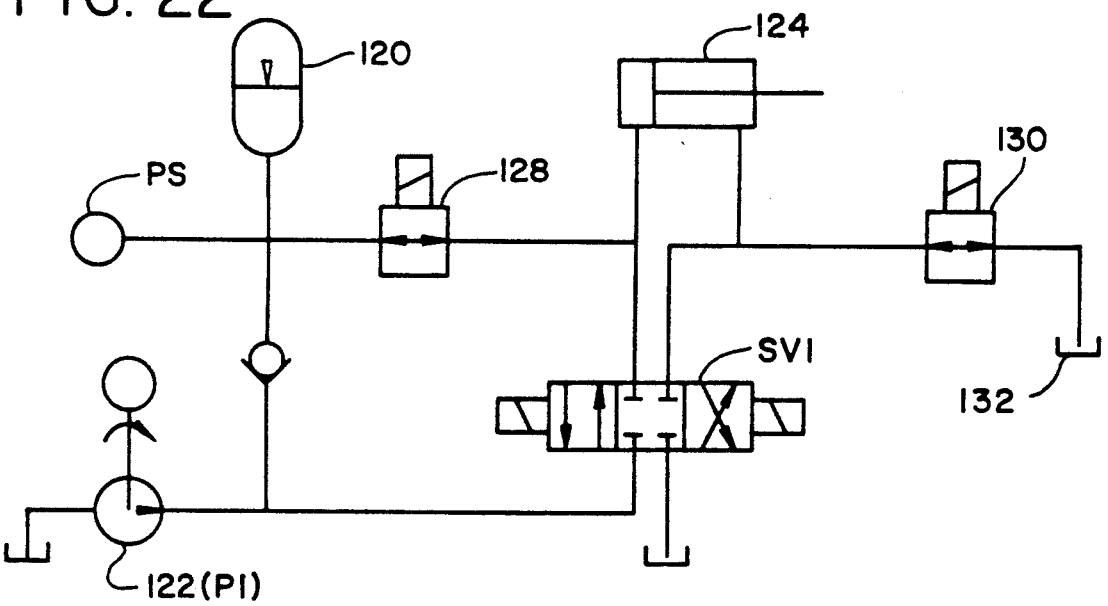
FIG. 22 is a schematic illustrating a modified hydraulic circuit with an accumulator feature.

The hydraulic circuit may also include accumulator means for supplying hydraulic fluid to the hydraulic cylinders 94, 96 to open the door leafs 24, 28 in the event of an electric power failure. A simplified circuit illustrating such an accumulator means is depicted in FIG. 22 where the accumulator is indicated at 120, the motor driven pump P1 at 122, the four-way solenoid valve at SV1 and one of the cylinders at 124. Accumulator pressure is controlled at all times by means of a pressure switch PS. Two solenoid valves indicated at 128, 130 are provided, one (128) in a line between the accumulator 120 and the cylinder 124 and the other (130) in a line between the cylinder 124 and a sump 132. These valves 128, 130 are energized to remain in a normally closed position. In the event of a power failure, the valves 128, 130 are de-energized to open, which allows hydraulic fluid to flow under pressure to the cylinder 124 to extend its cylinder rod to open a respective door leaf, with fluid flowing from the cylinder to the sump 132. The accumulator pressure can be set higher than the normal operating pressure of the circuit to reduce accumulator size. As an alternative to an accumulator 120, a hand pump (not shown) could be used to pump fluid from the cylinders 94, 96 in the event of a power failure.

The use of hydraulic cylinders 94, 96 is advantageous for many reasons, including providing for a very controlled movement of the door leafs 24, 28 so that they cannot slam open or shut due to the air flow through the mine passageway. Moreover, the opening and closing sequence of the door leafs can be controlled to insure that the leaf 24 with the sealing flap 80 closes after the other leaf 28 to avoid damage to the flap and to effect proper sealing. Also, two door systems 20 (forming an air-lock, for example, in a mine passageway) can be operated using the same power source. Installation is also facilitated since quick-connect couplings can be used to connect the power source to the cylinders 94, 96. Also, a two-stage pump (not shown) can be used which is designed to pump fluid to the cylinders 94, 96 at a relatively low volume and high pressure when air pressure exerts a relatively high force against movement of the door, and at a higher volume and lower pressure to move the door leafs 24, 28 more quickly when such air pressure exerts a lesser force.

The lintel-mounted cylinders 94, 96 provide an important assembly advantage, namely, the power mine door system of this invention may be erected in the field with only six pieces—the lintel 30, the two columns 26, the two door leaves 24, 28 and the power unit. To install the door, one need only to assemble the columns 26 and lintel 30, tilt the resulting assembly up, telescope the columns to the roof, hang the door leafs 24, 28, and connect the power unit to the cylinders 94, 96. No additional reaction points need be established.

An alternative power means is illustrated in FIGS. 23–26 as comprising winch means generally designated 138 including a drum 138A rotated by an electric motor 138B, and first and second reaches of cable designated 140 and 142 (FIG. 23) attached at one of their ends to the drum and at the other of their ends to respective door leafs 24, 28. The first reach of cable 140 extends vertically up from the drum 138A to a pulley 144 secured to suitable 146 secured to door leaf 24, these two pulleys generally being referred to as first pulley means. The end of the first reach of cable 140 is attached to a cable take-up means 148 fastened to the door leaf 24. The second reach of cable 142 extends vertically up from the drum 138A to a pulley 150 secured to suitable overhead structure 151 (which may be part of overhead structure 145), horizontally to a pulley 152 secured to an overhead structure 153 (which may also be a part of overhead structure 145), and then horizontally to a pulley 154 secured to door leaf 28, these three pulleys being referred to in a general sense as second pulley means. The end of the second reach of cable 142 is attached to second cable take-up means 156 fastened to door leaf 28. A spring return assembly generally indicated at 158 is provided for closing each door leaf 24, 28.

The winch motor 138B is coupled to the drum 138A by means of a clutch 162 which transfers power from the motor to rotate the drum in one direction for pulling the first and second reaches of cable 140, 142 to open the door leafs 24, 28, and to rotate the drum in the opposite direction for allowing the door leafs to close under the force exerted by the spring return assemblies 158, with the reaches of cable being maintained taught by the cable take-up means 148, 156. The clutch 162 is preferably one which limits the amount of force transferred to the drum 138A and thus to the cable 140, 142 to avoid injury to persons in the path of the door leafs 24, 28 as they open. To prevent excessive overrun or coasting of the drum which might foul the cable, a suitable braking mechanism (not shown) to brake the drum or motor shaft may be provided. The winch motor 138B and drum 138A are mounted on a winch frame 164 which is preferably secured to a column 26 of the door frame 22 (or a separate column similar to one used in the door frame) to hold the winch stable and in a position which will not unduly obstruct the passageway.

Figures 23, 25, 26:
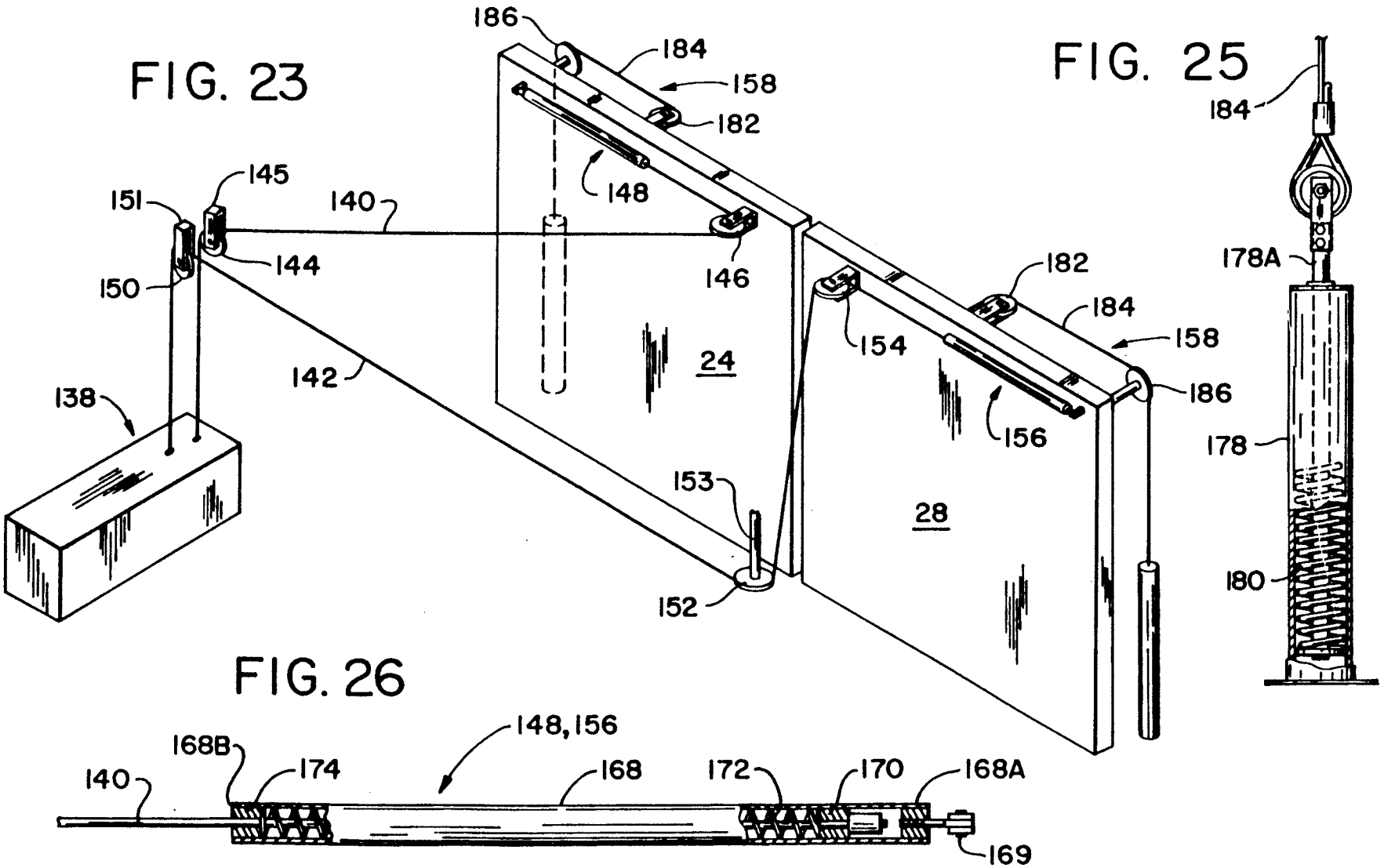
FIG. 23 is a schematic of a cable-operated power mine door opening system of the present invention.
FIG. 25 is an elevation of a spring assembly of the cable-operated system, with parts broken away to show details.
FIG. 26 is an elevation of a cable take-up of the cable-operated system, with parts broken away to show details.

Each cable take-up means 148, 156 is shown in FIG. 26 as comprising a long tube 168 pivoted at 169 adjacent one of its ends 168A to a respective door leaf and having a slide member 170 therein to which the cable (e.g., cable 140) is attached. A spring 172 is disposed between the slide member 170 and a cap 174 at the free (non-pivoted) end 168B of the tube, the arrangement being such that when the cable 140 is pulled to open the door leaf 24, the slide member 170 is slidable in the tube 168 to compress the spring. As the door leaf 24 is allowed to close under the force of the spring return assembly 158, the spring 172 will expand and cause the slide member 170 to move in the tube 168 to maintain the tension in the reach of cable between the winch 138 and the door leaf 24.

As shown in FIG. 25, each spring return assembly 158 comprises a cylinder 178, a cylinder rod 178A projecting up through the top of the cylinder 178, and a spring 180 in the cylinder compressible on extension of the cylinder rod and expansible to retract the cylinder rod. The cylinder 178 is suitably secured in fixed position relative to the door frame 22, and is preferably affixed to a column 26 at a respective side of the door frame. The assembly 158 also includes a pair of pulleys 182 secured to a respective door leaf (24 or 28), and a cable 184, one end of which is attached via a pulley 186 to the upper end of the cylinder rod 178A and the other end of which is attached to the door leaf. As the door leaf is pulled open, the cable 184 is pulled to extend the cylinder rod 178A and compress the spring 180. When the force exerted by the winch 138 is relieved, the spring 180 expands to retract the cylinder rod 178A to pull the door leaf closed.

To ensure that the door closing sequence is proper, that is, to ensure that the door leaf 24 with sealing flap 80 closes last, a different "point of taught" must be selected for the two cable reaches, that is, the system should be so designed that when the winch 138 is operated to pull the cables 140, 142, the cable 140 attached to the door leaf 24 with the sealing flap 80 should begin to pull that door leaf 28 open before the other cable 142 begins to pull the other door leaf 28 open. This may be accomplished by making the extent of travel (stroke) of the slide member 170 in the cable take-up 148 on the door leaf 24 with the flap shorter than that of the cable take-up 156 on the other door leaf 28, thereby insuring that the door leaf with the sealing flap 80 opens first and that the reverse will occur upon closing, thus sequencing the leafs without separate leaf drives, differential gear boxes, or differential drums.

Figure 24:
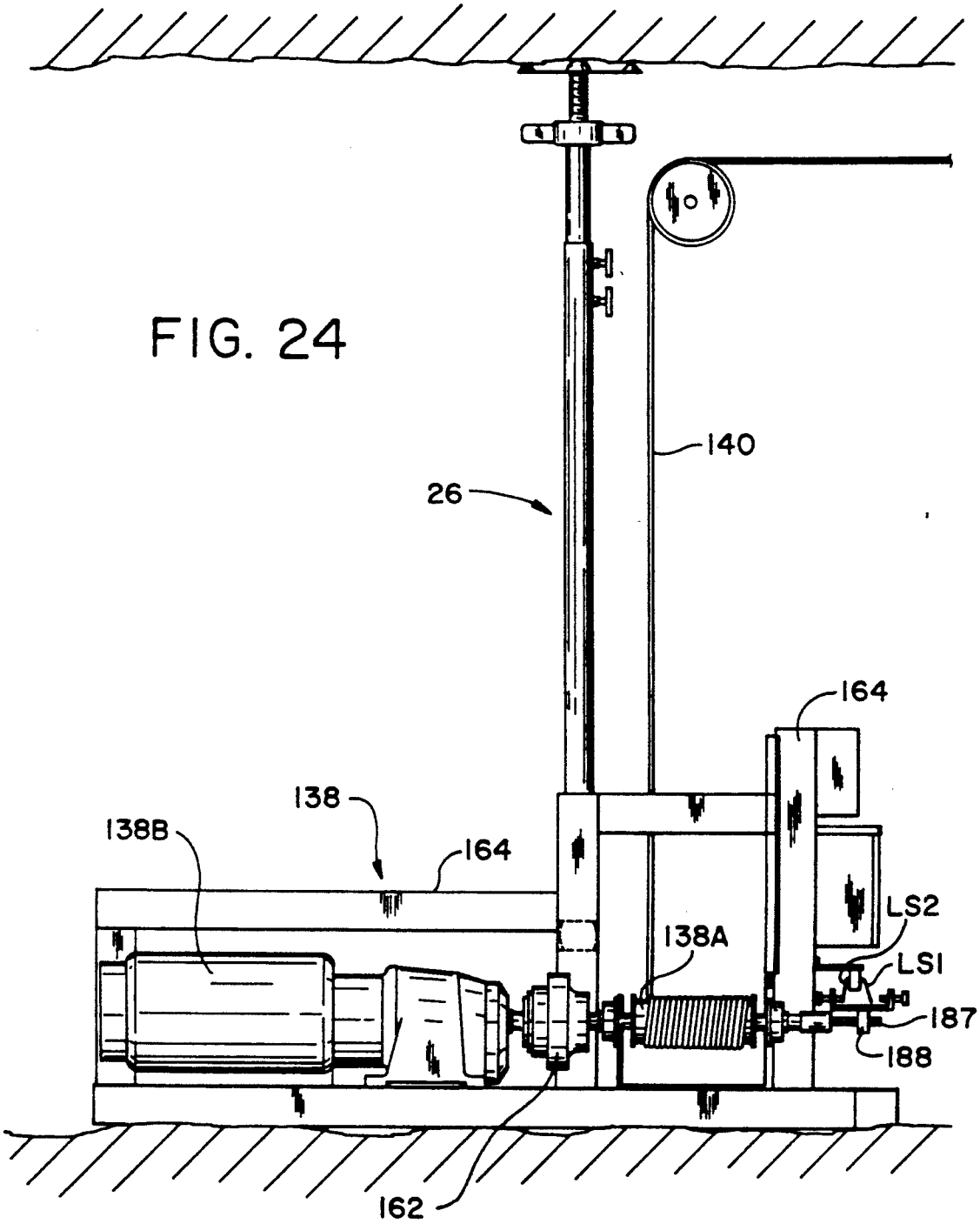
FIG. 24 is an elevation of a winch assembly for the cable-operated system of FIG. 23.
Figure 27:
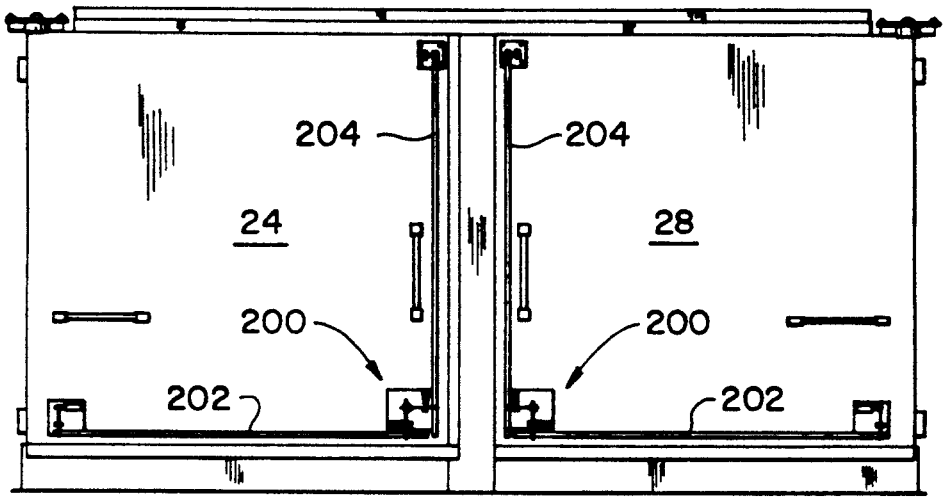
FIG. 27 is a front elevation of a mine door equipped with an obstruction sensing system of the present invention.

Suitable limit controls are provided to control operation of the motor 138B to stop the motor when the door leafs 24, 28 arrive at their fully open position and at their fully closed positions. Due to the dimensional instability of the mine passageway, these limit controls are preferably located in a dimensionally stable environment. For example, as shown in FIG. 24, the drum shaft 187 of the winch may be threadably engageable with a nut 188 to move the nut as the shaft rotates. This nut 188 may be engageable with suitable limit switches LS1, LS2 to stop the motor when the door leafs are fully open and fully closed. The positions of the limit switches may be adjusted periodically to ensure that the motor stops at the appropriate times.

A distinct advantage of the cable-operated door is that in case of nearly any malfunction, the door can be pushed open in an emergency against the closing force exerted by the spring assemblies 158.

Referring again to FIG. 1, it will be observed that one of the door leafs (leaf 24 as shown) has a man opening 190 therein sufficiently large to permit passage of a person therethrough so that a person may pass through the door leaf 24 when it is closed. A man door 192 is hinged on the door leaf 24 for swinging between a closed position (FIG. 1) for closing the man opening 190, and an open position (not shown). A man door 192 of this type is desirable if power to the door opening mechanism fails because, without power, the door leafs 24, 28 may be difficult to open due to the air pressures exerted on the relatively large surface areas of the door leafs, and due to the seals around the perimeters of the door leafs. Where very high pressures are involved, even opening the man door 192 may prove to be difficult. Therefore, in accordance with another aspect of this invention, a small pressure relief opening 194 is provided in the man door 192. This opening 194 is closed by a pressure relief door 196 mounted by hinges 198 on the man door 192. The pressure relief door 196 is movable between a closed position (FIG. 1) for closing the pressure relief opening 194 and an open position (not shown) for relieving pressure against the man door 192 to permit the man door more readily to be swung open to permit passage of a person therethrough.

Figures 28, 29, 30:
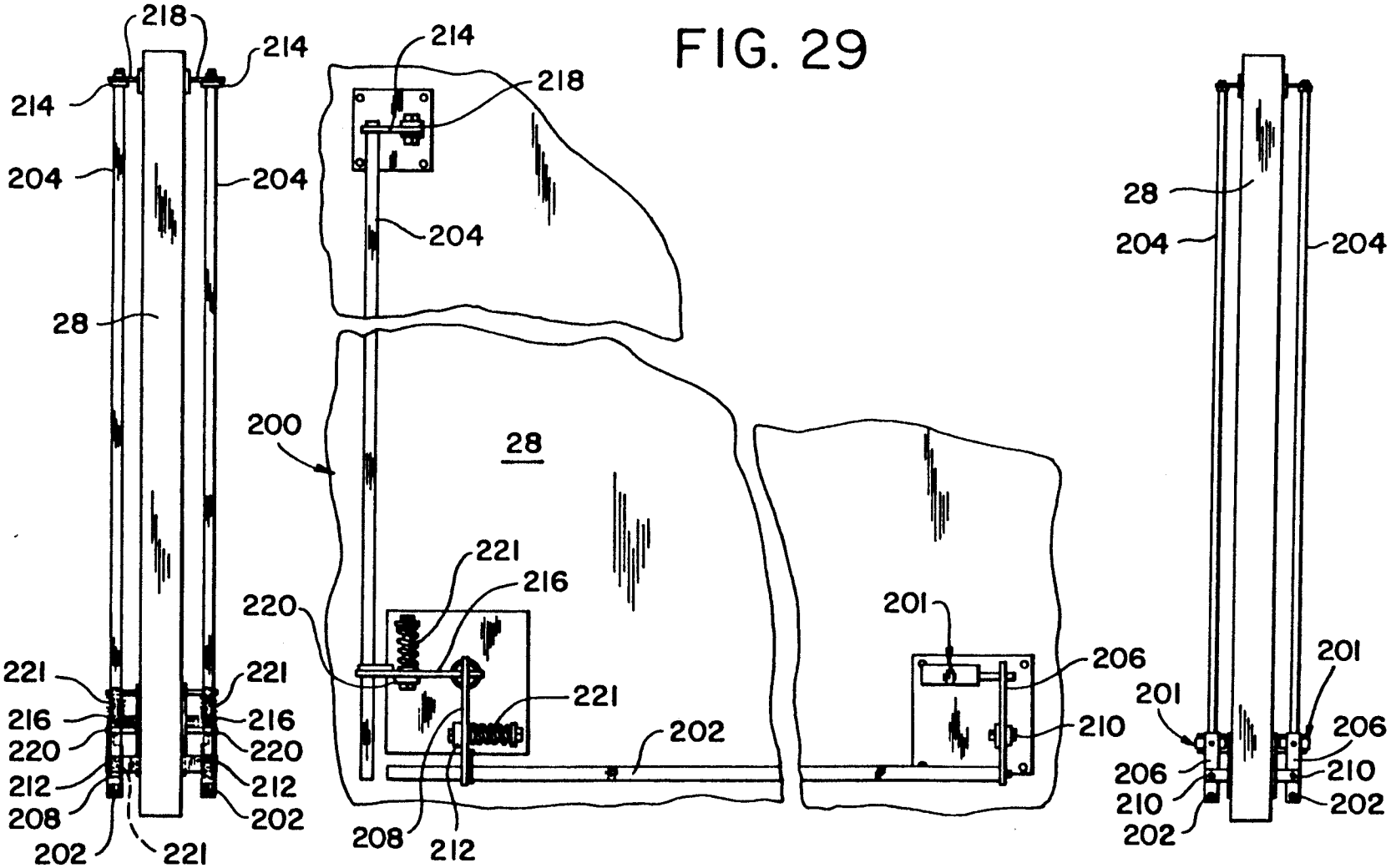
FIG. 28 is a side elevation of a door leaf as viewed from the outer edge of the door leaf showing the obstruction sensing system of FIG. 27.
FIG. 29 is a fragmentary front elevation of the sensing system of FIG. 27.
FIG. 30 is a side elevation of a door leaf of FIG. 27 as viewed from the inner edge of the door leaf.

The mine door system 20 of the present invention includes a sensor system, generally indicated at 200 in FIGS. 27–30, for detecting the presence of an obstruction in the path of a door leaf 24, 28 as it is swung open or closed. Generally, the sensor system 200 detects pressure on the door leaf caused by the obstruction, and in response trips a sensor switch 201 which de-energizes the electric motor powering the hydraulic pump P1 (in the hydraulic power mine door system), or the electric winch motor 138B (in the mechanical power mine door system), and thereby stops motion of the door leaf. As shown in FIGS. 27–30, sensor system 200 comprises a pair of actuator or "panic" bars 202, 204, movably mounted on each of the front and rear faces of each door leaf 24, 28. The first of these bars (202) extends generally horizontally at a location generally adjacent the bottom horizontal 68B edge of the door leaf, and the second bar (204) extends generally vertically at a location generally adjacent the free side edge 68D of the leaf. As shown in FIG. 29, the horizontal bar 202 is carried by two arms 206, 208, pivoted on the door leaf at 210 and 212, respectively, for pivoting of the bar about a generally horizontal axis. Arm 206 extends from the pivot 210 and is engageable with the sensor switch 201, the arrangement being such that inward movement of the bar 202 toward the door leaf face trips the sensor switch 201. The vertical actuator bar 204 is also carried by two arms 214, 216 pivoted at 218, 220, respectively, to the door leaf 28 for pivotal swinging movement of the bar about a generally vertical axis. Arms 216 and 208 are interconnected adjacent the bottom corner of the free edge 68D of the door leaf so that the two bars 202, 204 move conjointly. Thus, movement of either bar will trip the sensor switch 201. Torsion springs 221 urge the actuator bars away from the door leaf. The setting of the springs 218 can be adjusted as needed to control the amount of pressure required to move the actuator bars and thus trigger the sensor switch 201.

Figure 31:
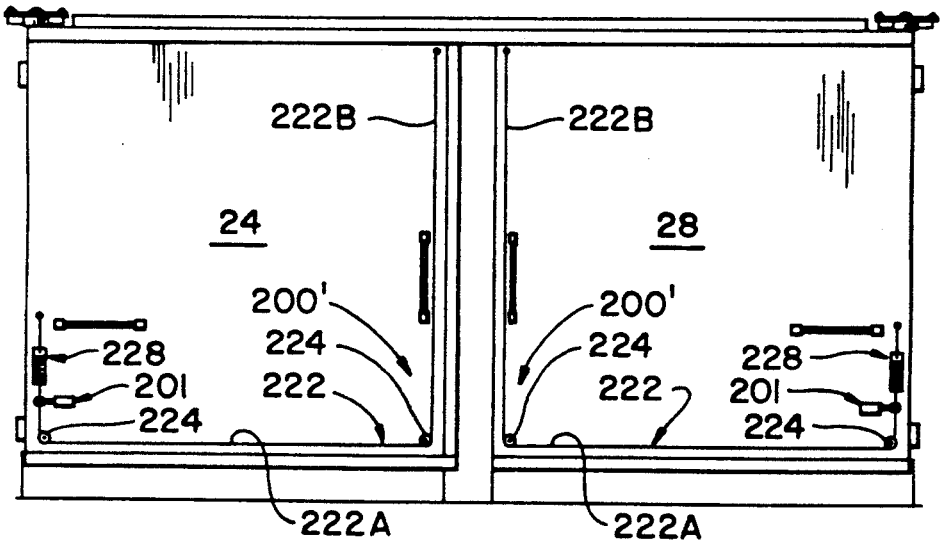
FIG. 31 is a front elevation of a mine door equipped with an obstruction sensing system of different design.
Figure 32:
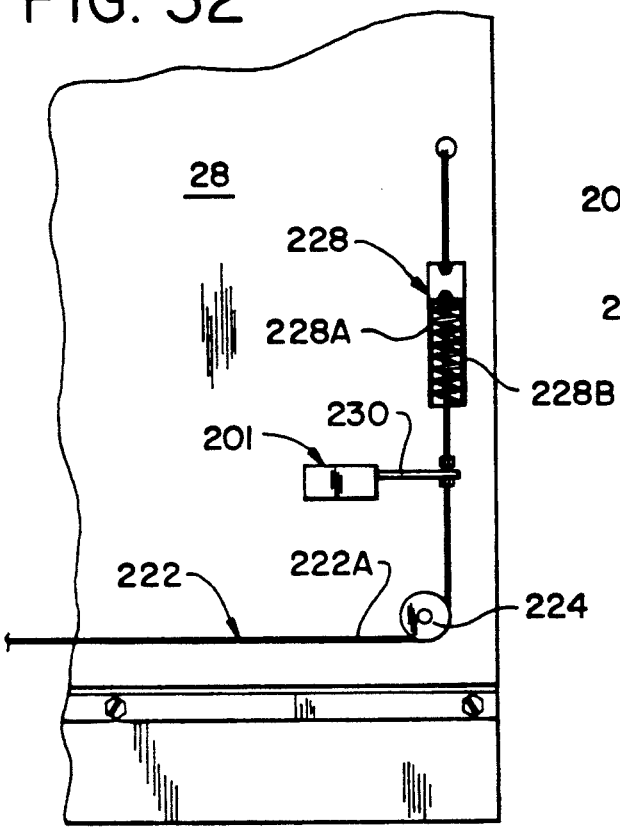
FIG. 32 is a fragmentary front elevation of a door leaf of FIG. 31 showing details of the sensing system.
Figure 33:
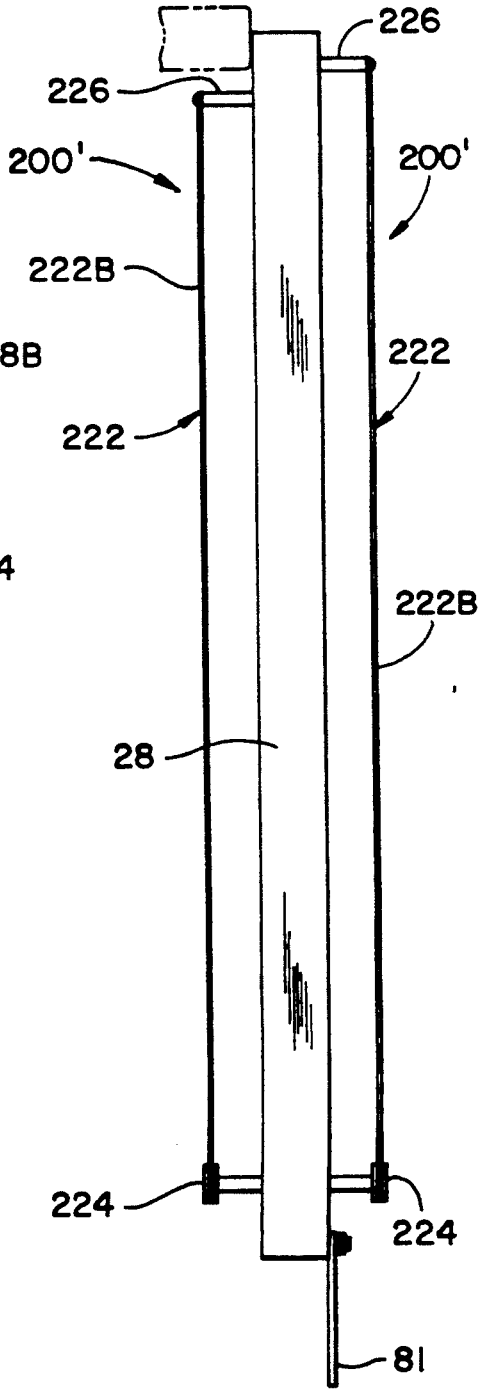
FIG. 33 is a side elevation of the door leaf of FIG. 32.
Figure 28A:
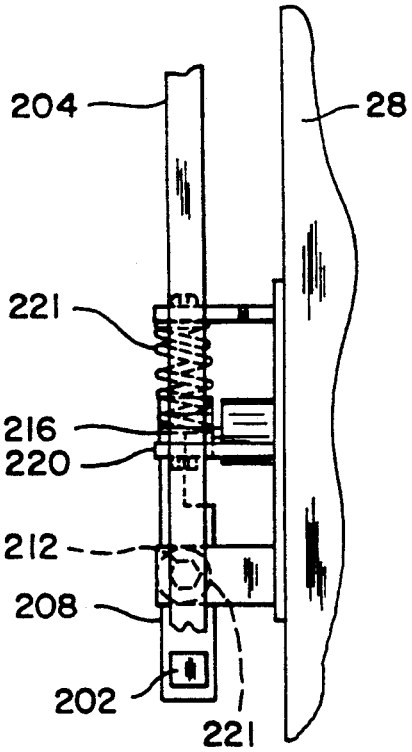
FIG. 28A is an enlarged portion of FIG. 28 showing details.

A second embodiment of the sensor system, generally designated 200', is shown in FIGS. 31–33. In this embodiment the actuator bars 202, 204 have been replaced by a cables 222 trained around pulleys 224 mounted on the front and rear faces of each door leaf 24, 28. Each cable 222 includes a horizontal reach 222A adjacent the lower edge 68B of the door leafs and a vertical reach 222B adjacent the free edge 68D of the door leafs. The cable 222 is fixed at one end to an anchor arm 226 projecting outwardly from the door leaf, and held relatively taut by a spring assembly 228 located at the other end of the cable. The spring assembly 228 includes a cylinder 228A attached at one end to the door leaf 28 and a compression spring 228B in the cylinder connected through a switch arm 230 of the switch 201 to the cable 222 such that deflection of the cable 222 compresses the spring 228B. The spring 228B is set to allow deflection of the cable 222 when subjected to a predetermined amount of pressure. The deflection of the cable 222 causes the switch arm 230 to be deflected so that the sensor switch 201 is activated to de-energize the electric motor powering the pump P1 or the motor 138B powering the winch 138. Also, if the cable 222 is cut, switch 201 will be activated to de-energize the motor.

Figure 34:
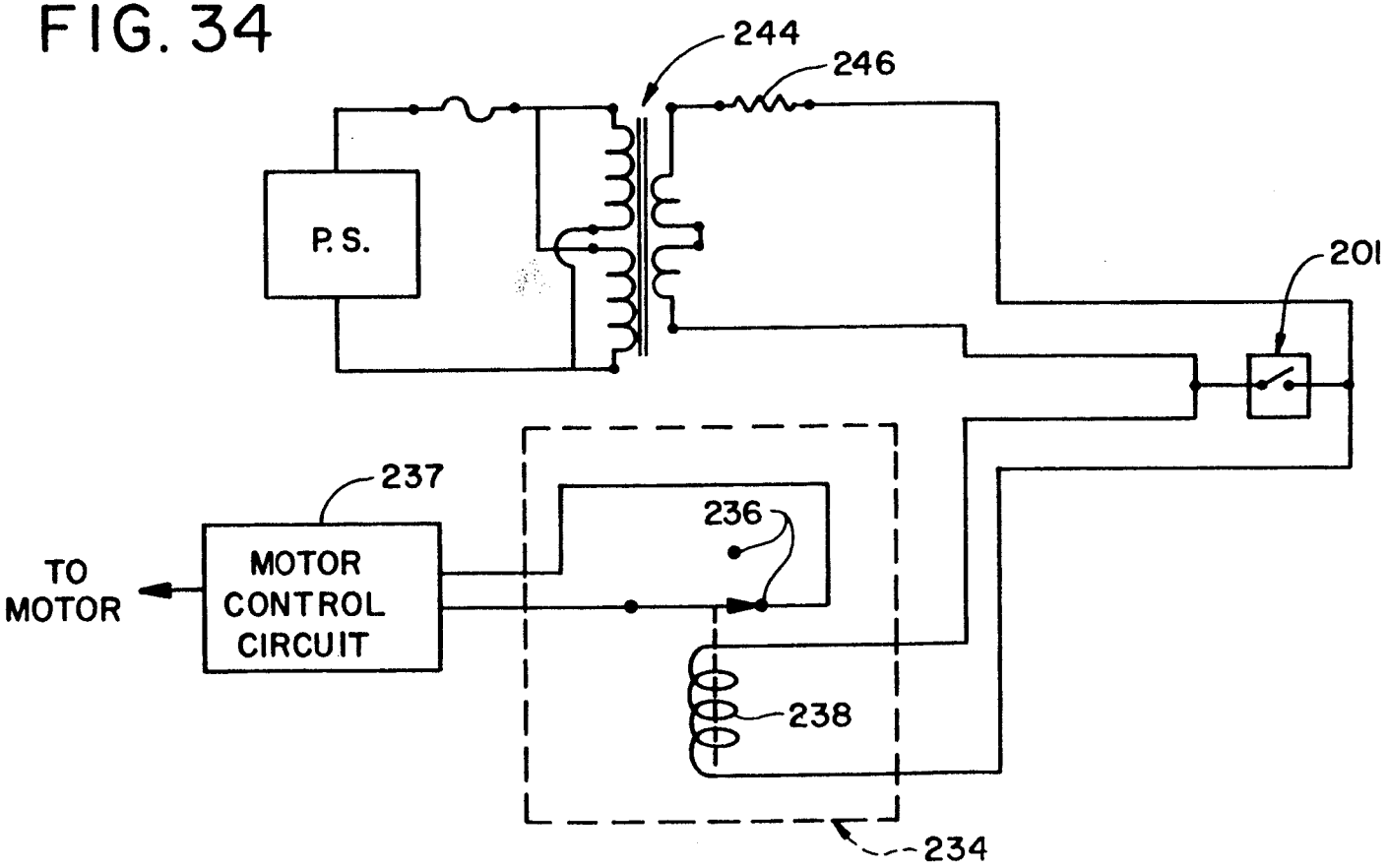
FIG. 34 is a schematic of a control circuit of the sensing system.

A control circuit (broadly "switch means") for de-energizing the electric motor is shown in FIG. 34. It includes means, indicated generally at 234, for selectively de-energizing the electric motor in response to movement of the actuator bars 202, 204 or cable 222, as sensed by the sensor switch 201. De-energizing means comprises an inhibiting circuit 234 connected to the electrical motor having an inhibiting set of relay contacts 236 which when open break the motor control circuit 237 to de-energize the electric motor. A power supply P.S. and a relay 238 (collectively "activating means") are employed to close and open the inhibiting relay contacts 236. In normal operation, the relay 238 is energized by the power supply and holds the inhibiting relay contacts 235 closed, as illustrated in FIG. 34. Thus, the inhibiting relay 238 is normally energized so that the electric motor will operate to open and close the door leaves. The sensor switch 201 is connected across the relay 238 so that when it is closed, the relay 238 is de-energized. In response, the inhibiting relay contacts 236 open to de-energize the motor. The relay 238 will be de-energized by closing the sensor switch 201, or by an open circuit or short circuit. Thus, the control circuit operates not only to stop motion of the door leafs 24, 28 when obstructions are detected, but to inhibit operation of the doors when there is either a break or a short in the control circuit.

The voltage supplied to the control circuit 234 is stepped down by a transformer 244 in the circuit. A resistor 246 is connected between the power supply and the sensor switch 201 to limit the current applied to the sensor switch to levels within the capacity of the switch and transformer. Additionally, the chance of high voltage electric shock due to a short in the control circuit 234 on the door leafs 24, 28 is minimized by the circuit of the present invention.

It will be understood that the sensor system 200 of this invention could take other forms. For example, strip switches sensitive to a predetermined amount of pressure could also be applied to the door leafs.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mine door system for installation in a passageway in a mine, comprising a door frame adapted to be installed in the passageway to define a generally rectangular doorway, said door frame having a top and opposite sides, a mine door comprising a pair of door leafs hinged on opposite sides of the door frame for swinging between an open position to permit passage through the doorway and a closed position in which the door leafs are generally coplanar and close the doorway, each door leaf being generally rectangular in shape with a top horizontal edge, a bottom horizontal edge, a generally vertical hinged side edge adjacent a respective side of the door frame, a generally vertical free side edge opposite the hinged side edge, a first leaf face facing away from the top of the door frame when the door leaf is closed, a second leaf face facing toward the top of the door frame when the door leaf is closed, the door leafs being so dimensioned that there is a substantial vertical gap between the door leafs when they are closed to accommodate convergence of side walls of the passageway, a relatively wide vertical sealing member secured to said first face of one of said door leafs adjacent its free side edge and projecting laterally therefrom for overlapping the first face of the other door leaf adjacent its free side edge thereby to cover said gap between the door leafs when the door leafs are closed, said door leafs having upper corner regions relieved to provide notch-like recesses adjacent the gap on opposite sides of the gap extending from the first leaf faces of the door leafs to the second leaf faces of the door leafs, said sealing member having an inclined upper end portion configured so that, when the door leafs are closed, it slopes upwardly through said recesses and said gap for substantially the full depth of the gap from said first face of each door leaf to said second face of each door leaf, said inclined upper end portion terminating in a tip engageable with the top of the door frame when the door leafs are closed thereby to inhibit the passage of air through the gap at a location adjacent the top of the door frame.

2. A mine door system as set forth in claim 1 wherein the recess in each door leaf is defined in part by a shoulder spaced below the top edge of the door leaf and extending inwardly from the free outer edge of the door leaf, said shoulder being inclined upwardly from said first leaf face to said second leaf face for supporting said inclined upper end portion of the sealing member.

3. A mine door system as set forth in claim 2 wherein said shoulder and said inclined upper end portion of the sealing member extend at about a 45° angle relative to the horizontal, and wherein said tip of the sealing member extends generally vertically.

4. A mine door system as set forth in claim 1 wherein each door leaf has a substantially continuous reinforcing structure around its perimeter, said recess in the door leaf eliminating a portion of said reinforcing structure to cause a discontinuity therein, and a corner brace bracing the reinforcing structure at said discontinuity adjacent the recess.

5. A mine door system as set forth in claim 1 wherein each door leaf has a reinforcing structure along its bottom and side edges, said reinforcing structure further comprising a generally horizontal segment of reinforcing structure spaced below the top edge of the door leaf at a level below the recess in the door leaf, said segment being connected to the reinforcing structure along the sides edges of the door leaf to provide a substantially continuous reinforcing structure around the door leaf.

6. A mine door system for installation in a passageway in a mine, comprising a door frame adapted to be installed in the passageway to define a doorway, said door frame comprising a pair of vertical columns at opposite sides of the doorway and a generally horizontal lintel spanning the columns and extending across the top of the doorway, a mine door mounted on said door frame for movement between open and closed positions, said lintel comprising a first horizontal hollow box beam lying generally in the plane of the vertical columns and a second horizontal box beam attached to the first beam at one side of the first beam and generally in the same horizontal plane as the beam so that the second beam does not project substantially above the first beam, thereby minimizing the overall depth of the lintel.

7. A mine door system as set forth in claim 6 further comprising a horizontal channel member secured along the upper surface of said first beam, said channel member opening upwardly for receiving building material for closing a gap between the lintel and the ceiling of the passageway.

8. A mine door system as set forth in claim 6 wherein each vertical column comprises a lower tubular column section, and a threaded upper column section generally coaxial with the lower column section, said lintel having a notch at each of its ends extending down from an upper surface of the lintel, and a nut in each notch threadably engageable with said upper column section, said nut and upper column section being relatively rotatable for adjusting the vertical extension of the upper column section relative to the lower column section to fit passageways of different heights.

9. A mine door system as set forth in claim 8 wherein each column further comprises a tubular intermediate column section coaxial with the lower section and telescopically adjustable relative thereto, and means for yieldably locking said intermediate column section in adjusted position relative to said lower column section, said upper column section comprising a threaded rod coaxially disposed inside said intermediate section and extending up out of the intermediate section, said nut being threaded on said threaded rod above said intermediate section.

10. A mine door system as set forth in claim 9 wherein said lintel comprises a tubular sleeve at each end of the lintel coaxial with a respective column, the upper end of the lower section of each column being engageable with the lower end of a respective sleeve, said intermediate section of the column extending up into the sleeve, and said threaded rod extending up above the sleeve with the nut disposed above the sleeve.

11. A mine door system for installation in a passageway in a mine, comprising a mine door having a relatively large surface area exposed to the flow of air through the passageway, said door having air seals at its perimeter to inhibit the flow of air therepast, a man opening in the mine door sufficiently large to permit passage of a person therethrough so that a person may pass through the mine door when it is closed, a man door hinged on the mine door for swinging between a closed position for closing the man opening and an open position, a pressure relief opening in the man door, and a pressure relief door mounted on the man door movable between a closed position for closing the pressure relief opening and an open position for relieving pressure against the man door to permit the man door more readily to be swung open to permit passage of a person therethrough.

12. In a mine door system for installation in a passageway in a mine, comprising a door frame adapted to be installed in the passageway to define a generally rectangular doorway, a mine door comprising at least one door leaf hinged on the door frame for swinging between an open position to permit passage through the doorway and a closed position for closing the doorway, said door leaf being generally rectangular in shape with a top horizontal edge, a bottom horizontal edge, a generally vertical side edge hinged to the door frame, a generally vertical free side edge opposite the hinged side edge, and opposite leaf faces, and electric power means for opening and closing the door leaf, the improvement comprising switch means for controlling the operation of said electric power means, and pressure-sensitive actuator means mounted on at least one face of door leaf, said actuator means being responsive to pressure due, for example, to contact with a person as the door opens or closes, to actuate said switch means to de-energize said electric power means.

13. A mine door system as set forth in claim 12 wherein said actuator means comprises a first actuator bar movably mounted on said one face of the door leaf to extend generally horizontally at a location generally adjacent the bottom horizontal edge of the door leaf, and a second actuator bar movably mounted on said one face of the door leaf to extend generally vertically at a location generally adjacent the free side edge of the door leaf, each actuator bar being adapted to move when subjected to a predetermined pressure for actuating said switch means.

14. A mine door system as set forth in claim 13 wherein said first and second actuator bars are connected for conjoint movement, and wherein said switch means comprises a switch mounted on the door leaf and having a switch actuator positioned for actuation in the event of said conjoint movement to de-energize said electric power means.

15. A mine door system as set forth in claim 12 wherein said actuator means comprises a plurality of pulleys mounted on said one face of the door leaf, and cable trained around said pulleys to lie in a plane generally parallel to and spaced from one face of the door leaf, said cable having a first generally horizontal reach spaced generally adjacent the bottom horizontal edge of the door leaf, and a second generally vertical reach generally adjacent the free side edge of the door leaf, each reach of cable being adapted to deflect when subjected to a predetermined pressure for actuating said switch means.

16. A mine door system as set forth in claim 12 wherein said switch means comprises:

means for selectively de-energizing the electric power means;

means for sensing movement of said actuator means; and means for activating said de-energizing means in response to movement sensed by said sensing means.

17. A mine door system as set forth in claim 16 further comprising means for limiting the current and/or voltage supplied to said sensing means.

18. A mine door system as set forth in claim 16 wherein said activating means comprises means for activating said de-energizing means in response to an open circuit or a short circuit between said sensing means and said activating means.

19. A mine door system as set forth in claim 18 wherein said de-energizing means comprises an inhibiting circuit connected to said electric power means, and a set of contacts which, when open, de-energizes the inhibiting circuit to de-energize said electric power means; wherein said sensing means comprises a switch which closes in response to movement of said actuator means; and wherein said inhibiting circuit comprises a power supply and a relay energized by said power supply for maintaining said set of contacts closed, said switch being connected across said relay so that the relay is de-energized when the switch is closed whereupon said set of contacts is adapted to open to de-energize the motor.

20. A mine door system as set forth in claim 19 further comprising a resistor connected between said power supply and said second switch for limiting the current and/or voltage supplied to said sensing means.

* * * * *

UNITED STATES PATENT AND TRADEMARK OFFICE

CERTIFICATE OF CORRECTION

PATENT NO. : 5,222,838

DATED : June 29, 1993

INVENTOR(S) : William R. Kennedy et al.

It is certified that error appears in the above-identified patent and that said Letters Patent is hereby corrected as shown below:

Column 17, claim 15, line 15, "from one from" should read ---from said one face---.

Signed and Sealed this

Eighth Day of February, 1994

Bruce Lehman

*Attest:*

BRUCE LEHMAN

*Attesting Officer*

*Commissioner of Patents and Trademarks*